US008254811B2

(12) United States Patent
Andoh et al.

(10) Patent No.: US 8,254,811 B2
(45) Date of Patent: Aug. 28, 2012

(54) IMAGE FORMING APPARATUS FOR CONTROLLING MOVEMENT OF A MOVING MEMBER

(75) Inventors: Toshiyuki Andoh, Kanagawa (JP); Takashi Hashimoto, Kanagawa (JP); Takashi Hodoshima, Kanagawa (JP); Hidetaka Noguchi, Hyogo (JP); Seiji Hoshino, Kanagawa (JP); Tatsuhiko Oikawa, Kanagawa (JP); Tetsuo Watanabe, Kanagawa (JP)

(73) Assignee: Ricoh Company, Limitied, Tokyo (JP)

( * ) Notice: Subject to any disclaimer, the term of this patent is extended or adjusted under 35 U.S.C. 154(b) by 661 days.

(21) Appl. No.: 12/379,505

(22) Filed: Feb. 24, 2009

(65) Prior Publication Data

US 2009/0220277 A1 Sep. 3, 2009

(30) Foreign Application Priority Data

Mar. 3, 2008 (JP) ..... 2008-051618

(51) Int. Cl.
*G03G 15/00* (2006.01)
*G03G 15/08* (2006.01)

(52) U.S. Cl. ..... 399/167; 399/45; 399/121

(58) Field of Classification Search ..... 399/121, 399/167, 45, 66, 302, 308, 313
See application file for complete search history.

(56) References Cited

U.S. PATENT DOCUMENTS

| | | | |
|---|---|---|---|
| 6,949,896 | B2 | 9/2005 | Andoh et al. |
| 7,330,009 | B2 | 2/2008 | Andoh et al. |
| 2004/0160646 | A1 | 8/2004 | Kudo et al. |
| 2005/0025511 | A1 * | 2/2005 | Watabe |
| 2005/0099153 | A1 | 5/2005 | Komatsu et al. |
| 2007/0076080 | A1 * | 4/2007 | Knierim et al. |
| 2007/0103531 | A1 * | 5/2007 | Jones et al. |
| 2007/0152622 | A1 | 7/2007 | Komatsu et al. |
| 2007/0172257 | A1 | 7/2007 | Matsuda et al. |
| 2007/0189815 | A1 | 8/2007 | Andoh et al. |
| 2009/0026689 | A1 | 1/2009 | Noguchi et al. |

FOREIGN PATENT DOCUMENTS

| | | | |
|---|---|---|---|
| JP | 04-242276 | | 8/1992 |
| JP | 06274051 | A * | 9/1994 |
| JP | 2005094820 | A * | 4/2005 |
| JP | 2006259483 | A * | 9/2006 |
| JP | 2007030449 | A * | 2/2007 |
| JP | 2007293032 | A * | 11/2007 |

* cited by examiner

*Primary Examiner* — Walter L Lindsay, Jr.

*Assistant Examiner* — Milton Gonzalez

(74) *Attorney, Agent, or Firm* — Harness, Dickey & Pierce, P.L.C.

(57) ABSTRACT

An image-carrier driving unit drives an image carrier. An image forming unit forms an image on the image carrier. A moving-member driving unit drives a moving member that is movable towards and away from the image carrier. A detecting unit detects a position of the moving member at predetermined sampling times while the moving member is moving. A movement control unit performs a feedback control on the moving-member driving unit such that a detection result of the detecting unit follows a target value corresponding to each of the predetermined sampling times when the moving member moves while the image forming unit is forming the image on the image carrier.

13 Claims, 10 Drawing Sheets

NO SHEET

THIN SHEET

THICK SHEET

IMAGE FORMING APPARATUS FOR CONTROLLING MOVEMENT OF A MOVING MEMBER

CROSS-REFERENCE TO RELATED APPLICATIONS

The present application claims priority to and incorporates by reference the entire contents of Japanese priority document 2008-051618 filed in Japan on Mar. 3, 2008.

BACKGROUND OF THE INVENTION

1. Field of the Invention

The present invention relates to an image forming apparatus, such as a copier, a printer, or a facsimile, which employs an image forming method such as an electrophotography, an electrostatic recording technique, an ionography, or a magnetic recording technique.

2. Description of the Related Art

In recent years, there has been a growing demand for image forming apparatuses that are versatile enough to be able to form images on a wide range of recording media with different thicknesses, such as thin sheets, thick sheets, postcards, and envelopes. Many image forming apparatuses adopt a so-called intermediate transfer technique because it is advantageous in meeting the above demand. In general, according to the intermediate transfer technique, a toner image formed on a latent-image carrier, such as a photosensitive member, is subjected to a primary transfer onto an intermediate transfer body, which is an image carrier, and then the toner image on the intermediate transfer body is subjected to a secondary transfer onto a recording medium by passing the recording medium between the intermediate transfer body and a secondary transfer member that makes contact with the intermediate transfer body to form a transfer nip. In such an image forming apparatus, when the recording medium enters a secondary transfer portion (contact portion between the intermediate transfer body and the secondary transfer member), the speed of the intermediate transfer body, which is driven at a constant speed, fluctuates, and an image is distorted at the first transfer portion. Consequently, the image that is eventually formed on the recording medium degrades. This problem is noticeable particularly if the recording medium is relatively thick.

In order to overcome this problem, Japanese Patent Application Laid-open No. H4-242276 discloses a technique for changing a space between the intermediate transfer body and the secondary transfer member according to the thickness of the recording medium to suppress speed fluctuations of the intermediate transfer body that occur when the recording medium enters the contact portion between the intermediate transfer body and the secondary transfer member or when the recording medium exits the contact portion. By doing so, it is possible to suppress, to some degree, the degradation in the image that is eventually formed on the recording medium.

However, in the image forming apparatus described in Japanese Patent Application Laid-open No. H4-242276, the thickness of the recording medium is measured before the recording medium enters the secondary transfer portion, and the space between the intermediate transfer body and the secondary transfer member can be changed based on the measurement result (i.e., according to the thickness of the recording medium). Here, consider the timing of moving the secondary transfer member when images are to be formed on a plurality of recording media. If the recording media to be conveyed to the secondary transfer portion have the same thickness (i.e., recording media with different thicknesses are not mixed), then the secondary transfer member is moved by a predetermined distance based on the information about the measured thickness of a recording medium when a printing job is started, images are formed on the recording media during the job while maintaining the space between the intermediate transfer body and the secondary transfer member, and the secondary transfer member is returned to its original position when the job ends. In other words, if the recording media to be conveyed to the secondary transfer portion have the same thickness (i.e., recording media with different thicknesses are not mixed), because the secondary transfer member does not move while the toner image is being subjected to primary transfer onto the intermediate transfer body, speed fluctuations of the intermediate transfer body due to the movement of the secondary transfer member do not occur.

However, if recording media with different thicknesses are mixed, it becomes necessary to move the secondary transfer member while the toner image is primary-transferred onto the intermediate transfer body. Consequently, the intermediate transfer body suffers from speed fluctuations as a result of moving the secondary transfer member to change the space between the intermediate transfer body and the secondary transfer member. Thus, the images that are eventually formed on the recording media are distorted as in the conventional technology. The speed fluctuations produced in the intermediate transfer body as a result of moving the secondary transfer member to change the space between the intermediate transfer body and the secondary transfer member are likely to be induced mainly from vibrations generated in the intermediate transfer body by a shock occurring when the movement of the secondary transfer member is started or stopped or from a change in pressure due to a change in the space between the intermediate transfer body and the secondary transfer member. Therefore, if the recording medium is, for example, a thick sheet, the secondary transfer member is moved a longer distance, and the shock or the pressure changes greatly when the movement of the secondary transfer member is started or stopped. Consequently, it leads to larger speed fluctuations in the intermediate transfer body. In short, if a plurality of recording media to be conveyed to the secondary transfer portion includes, for example, a thick sheet, the images suffer from marked degradation.

The above-mentioned problem of the image quality degradation due to the movement of the secondary transfer member occurs not only when the secondary transfer member is moved towards the surface of the intermediate transfer body while the toner image is being transferred at the primary transfer portion. For example, the same problem may occur when a moving member, such as a cleaning member or a transfer member, is moved towards the surface of the image carrier while the image on the surface of the image carrier is being transferred onto the intermediate transfer body (or onto the recording medium in the case of the direct transfer method). Furthermore, the same problem may occur when the moving member is moved towards the surface of the image carrier, for example, while a latent image is being written on the surface of the image carrier.

In short, there is a risk that the above-mentioned problem occurs when a moving member is moved towards the surface of the image carrier while an image is being formed on the image carrier or while the image on the image carrier is being transferred to another transfer medium (e.g., the intermediate transfer body or a recording medium).

SUMMARY OF THE INVENTION

It is an object of the present invention to at least partially solve the problems in the conventional technology.

According to one aspect of the present invention, there is provided an image forming apparatus including an image carrier on which an image is formed; an image-carrier driving unit that drives the image carrier; an image forming unit that forms the image on the image carrier; a moving member that is movable towards and away from the image carrier; a moving-member driving unit that drives the moving member; a detecting unit that detects a position of the moving member at predetermined sampling times while the moving member is moving; and a movement control unit that performs a feedback control on the moving-member driving unit such that a detection result of the detecting unit follows a target value corresponding to each of the predetermined sampling times when the moving member moves while the image forming unit is forming the image on the image carrier.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
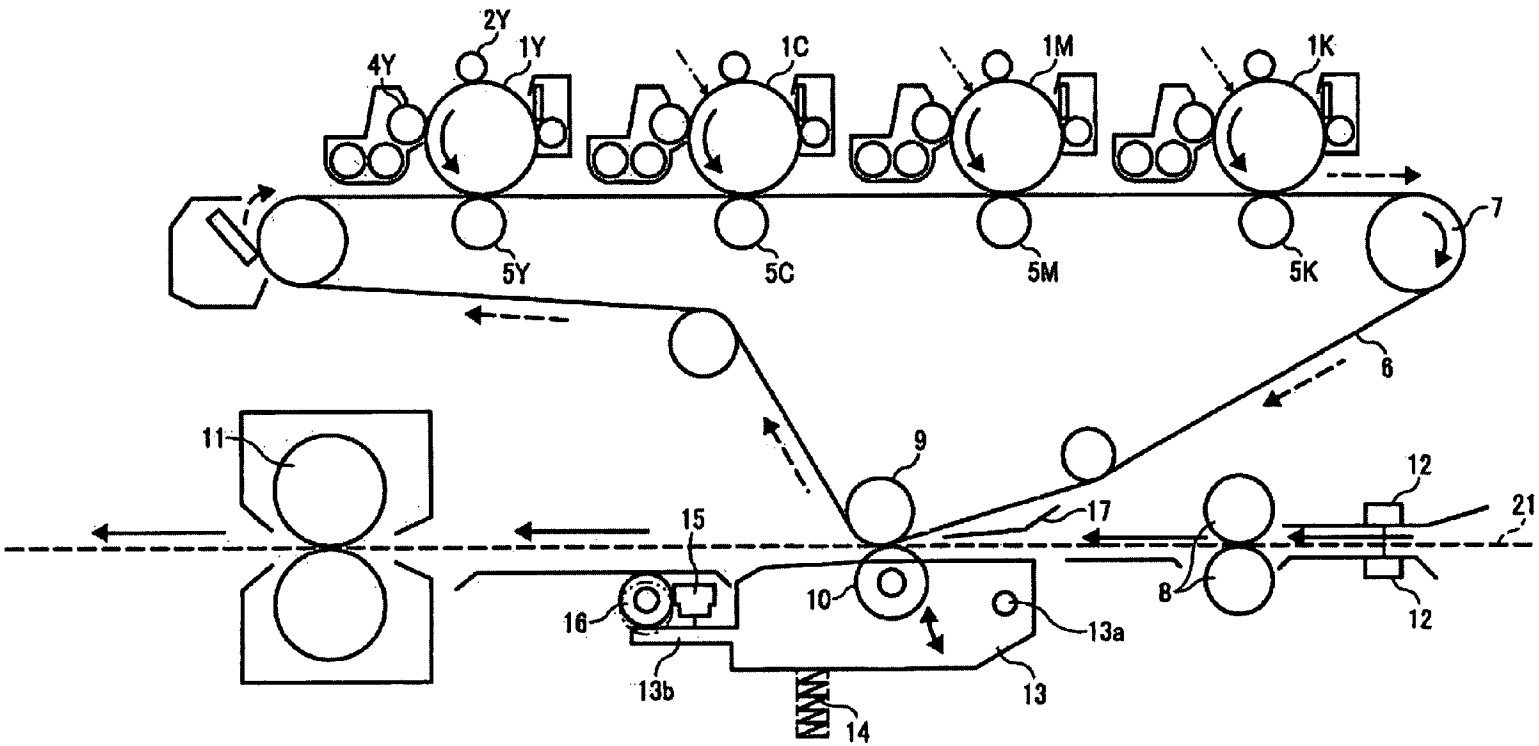
FIG. 1 is a schematic diagram of an image forming unit of a copier according to a first embodiment of the present invention.

FIG. 1 is a schematic diagram of an image forming unit of a copier serving as an image forming apparatus according to a first embodiment of the present invention. The copier according to the first embodiment is a tandem-type image forming apparatus including photosensitive members serving as latent-image carriers for four colors of yellow (Y), cyan (C), magenta (M), and black (K), respectively. In FIG. 1, components/members corresponding to each color are designated with reference numerals followed by the corresponding color symbol (Y, C, M, and K). Because the components/members with the same reference numerals followed by different color symbols (Y, C, M, and K) have substantially the same structure, only one representative component/member from among the components/members with the same reference numerals will be described by omitting the color symbols.

A photosensitive member 1 serving as a latent-image carrier is charged by a charging unit 2 so that its surface carries a uniform potential. Then, an electrostatic latent image is formed on the surface by performing a writing exposure with an exposure unit based on information about the image to be formed. Toner adheres to an image portion of the electrostatic latent image on the surface of the photosensitive member 1 via a development processing by a developing device 4 to form a toner image. Thereafter, the toner image is transferred onto an intermediate transfer belt 6, serving as an image carrier, at a primary transfer portion by the effect of a bias applied to a primary transfer roller 5.

The photosensitive members 1 are arranged side-by-side along the path of the surface of the intermediate transfer belt 6 to be in contact with the intermediate transfer belt 6. The toner images formed on the photosensitive members 1 are transferred onto the intermediate transfer belt 6 at their respective primary transfer portions such that the toner images are sequentially aligned. The intermediate transfer belt 6 is driven while looped over a plurality of rollers including a belt-driving roller 7. The belt-driving roller 7 is rotationally driven by a driving source such as a motor (not shown).

A full-color toner image formed on the intermediate transfer belt 6 is transferred at a secondary transfer portion onto a recording sheet serving as a recording medium that is conveyed along a conveying path 21 in the direction indicated by the arrows shown in FIG. 1. The recording sheet is conveyed from a sheet feeding unit (not shown) of the image forming apparatus, having a front end position adjusted at a pair of registration rollers 8, and is sent to the secondary transfer portion. At the secondary transfer portion, an electric field is formed between a secondary transfer roller 10 disposed on the outer side of the intermediate transfer belt 6 and a secondary transfer pairing roller 9 on the inner side of the intermediate transfer belt 6, to transfer the toner image onto the recording sheet. The shaft of the secondary transfer roller 10 is supported by the frame of a secondary transfer unit 13. The secondary transfer unit 13 can be rotated about a swing fulcrum 13*a* and is urged by the urging force of a spring 14 in the direction in which the secondary transfer roller 10 is pressed against the secondary transfer pairing roller 9. The secondary transfer unit 13 rotates about the swing fulcrum 13*a* along with the rotation of a moving cam 16 that is rotationally driven by a motor (not shown).

According to the first embodiment, the secondary transfer unit 13 is swung by the moving cam 16, and the distance between the swing fulcrum 13*a* of the secondary transfer unit 13 and the point of application of the moving cam 16 is larger than the distance between the swing fulcrum 13*a* and the secondary transfer roller 10. Therefore, the moving distance of the secondary transfer roller 10 is smaller than the moving distance of the secondary transfer unit 13 at the point of application of the moving cam 16, and thus the position of the secondary transfer roller 10 can be adjusted in small steps.

In addition, according to the first embodiment, a secondary-transfer position detector 15, which is a sensor that detects the position of the secondary transfer unit 13, is provided so that the secondary transfer roller 10 can be moved with high accuracy to support a wide range of sheet thicknesses by controlling the rotation of the moving cam 16 while detecting the position of the secondary transfer unit 13. The secondary-transfer position detector 15 detects the position of a detection portion 13*b*, which is a part of the secondary transfer unit 13. Because the distance between the swing fulcrum 13*a* and the detection portion 13*b* is larger than the distance between the swing fulcrum 13*a* and the secondary transfer roller 10, the position of the secondary transfer roller 10 can be identified with higher resolution than the detection resolution of the secondary-transfer position detector 15, thereby making it possible to control the position of the secondary transfer roller 10 with high accuracy.

As described above, the secondary transfer roller 10 is pressed against the intermediate transfer belt 6 and rotates while being in contact with the intermediate transfer belt 6 or the recording sheet 20. The recording sheet on which the toner image is transferred passes through a fixing unit 11, where the toner image is fixed onto the recording sheet through heat and pressure.

In such an image forming process, it is important that the photosensitive member 1 and the intermediate transfer belt 6 be driven at a constant speed. Because any speed fluctuation in the photosensitive member 1 causes the image to expand or contract, a speed fluctuation, even though it is very slight, causes a nonuniform density in the image. Furthermore, regardless of whether the speed of the photosensitive member 1 is kept constant, a difference in speed occurs between the intermediate transfer belt 6 and the photosensitive member 1 at the primary transfer portion if the intermediate transfer belt 6 exhibits speed fluctuations. This also causes image expansion or contraction and nonuniform image density.

Factors responsible for speed fluctuations of the intermediate transfer belt 6 include rotation fluctuation of the driving source, such as a motor, fluctuation in a driving-transmission system, decentering of a driving roller or a driven roller having the belt looped thereover, variation in belt thickness, and random fluctuations during operation. The random fluctuations are likely to occur, for example, when a recording sheet passes through a conveying nip.

Figure 2A:
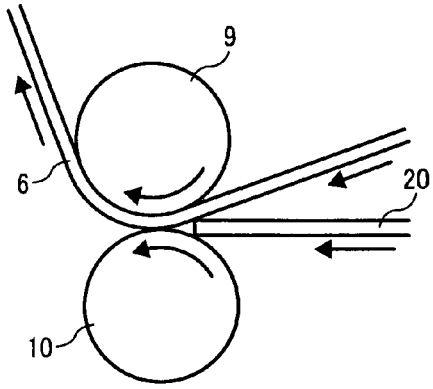
FIGS. 2A and 2B are schematic diagrams illustrating a recording medium entering a conventional secondary transfer portion.
Figure 2B:
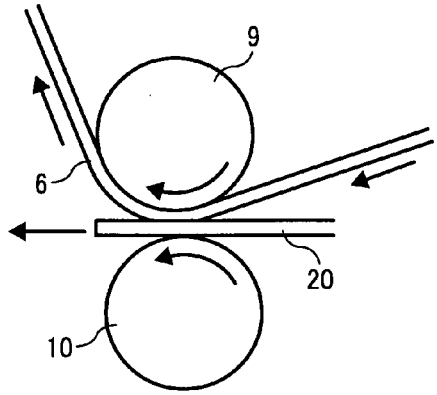

FIG. 2A is a schematic diagram of a recording sheet 20 entering a nip portion. FIG. 2B is a schematic diagram of the recording sheet 20 being conveyed at the nip portion. Referring to FIGS. 2A and 2B, when the recording sheet 20 is about to enter the nip portion between the secondary transfer roller 10 and the secondary transfer pairing roller 9 at the secondary transfer portion, the belt speed temporarily decreases because the secondary transfer pairing roller 9 experiences increased load to force the front end of the recording sheet into the nip. If a transfer is in progress at the primary transfer portion at this time, the image on the intermediate transfer belt 6 suffers from nonuniformity.

Figure 3A:
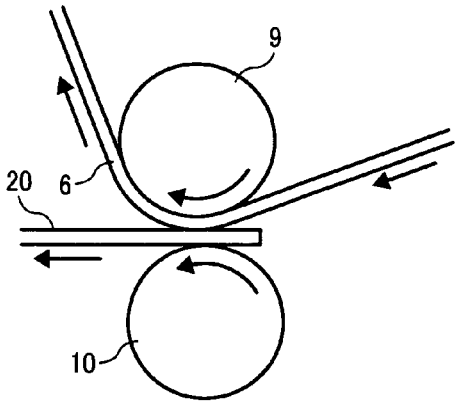
FIGS. 3A and 3B are schematic diagrams illustrating a recording medium exiting the secondary transfer portion.
Figure 3B:
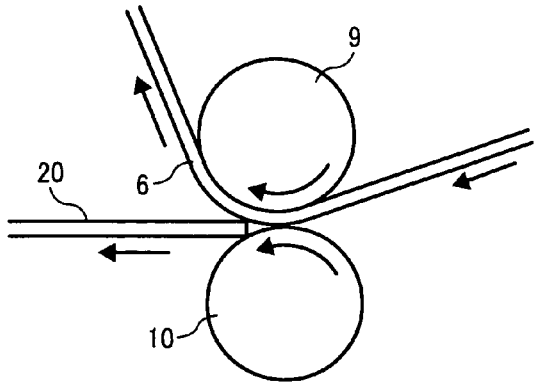

FIG. 3A is a schematic diagram of the recording sheet 20 exiting the nip portion. FIG. 3B is a schematic diagram of the recording sheet 20 that has exited the nip portion. Referring to FIGS. 3A and 3B, when the rear end of the recording sheet 20 passing through the secondary transfer portion is about to exit the nip between the secondary transfer roller 10 and the secondary transfer pairing roller 9, the belt speed temporarily increases because the load on the secondary transfer pairing roller 9 is reduced. This is also responsible for nonuniform image density because a speed difference occurs between the photosensitive member 1 and the intermediate transfer belt 6 at the primary transfer portion.

Ways of reducing load fluctuations of the intermediate transfer belt 6 caused by the recording sheet 20 passing through the secondary transfer portion include a technique for securing a predetermined space between the secondary transfer roller 10 and the secondary transfer pairing roller 9 to reduce a shock when the front end of the recording sheet enters the nip and the rear end of the recording sheet exits the nip. This technique will be described in detail with reference to FIGS. 4A, 4B, and 4C.

Figure 4A:
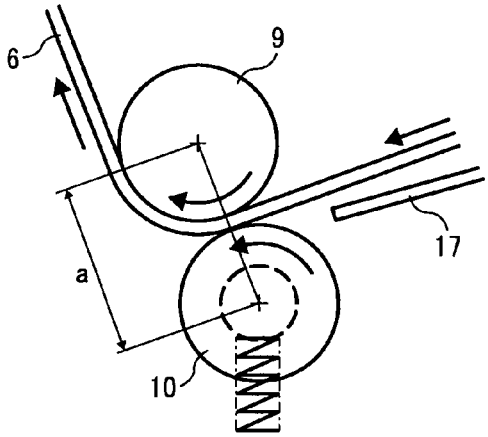
FIGS. 4A to 4C are schematic diagrams for explaining a technique for reducing a shock when the front end of recording sheet enters and the rear end of the recording sheet exits.

In FIG. 4A, there is no sheet at the secondary-transfer nip portion. In the image forming apparatus according to the first embodiment, in order to enhance the image quality, a region where only the secondary transfer roller 10 and the intermediate transfer belt 6 are in contact (a so-called pre-nip portion) is provided upstream of the region where the nip is formed by the secondary transfer roller 10 and the secondary transfer pairing roller 9, with the intermediate transfer belt 6 disposed therebetween.

Furthermore, because the toner image formed on the intermediate transfer belt 6 may be distorted if the sheet comes into contact with the intermediate transfer belt 6 in an area not experiencing the transfer field, upstream of the nip portion, not only is a certain angle provided between the sheet-conveying direction and the intermediate-belt conveying direction but also a pre-recording sheet guide 17 that regulates the sheet position when the sheet enters the nip portion is provided to minimize the risk of the sheet coming into contact with the belt upstream of the nip.

In a state where the recording sheet 20 is not present at the secondary transfer portion, the moving cam 16 is disposed at a position where it is out of contact with the secondary transfer unit 13 (the position indicated by the solid line in FIG. 1, where the secondary transfer roller 10 is not pressed down by the moving cam 16). As shown in FIG. 4A, in this state, the secondary transfer roller 10 is pressed against the intermediate transfer belt 6 and the secondary transfer pairing roller 9 by means of the spring 14. Hereinafter, this state is referred to as the "normal state," and the shaft-to-shaft distance between the secondary transfer pairing roller 9 and the secondary transfer roller 10 in the "normal state" is assumed to be a.

Figure 4B:
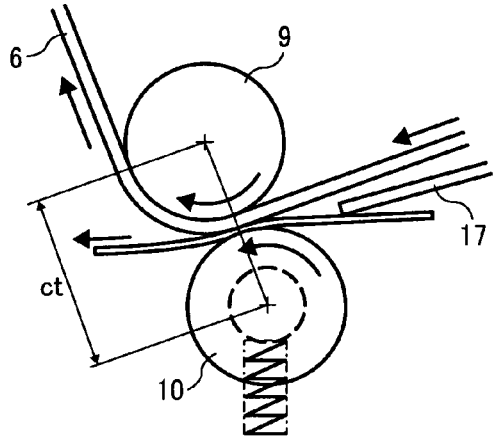

Next, when normal sheet is made to pass through the secondary transfer portion in a state where the secondary transfer roller 10 is not pressed down by the moving cam 16, the sheet proceeds along the shape of the secondary-transfer nip portion, as shown in FIG. 4B, and the shaft-to-shaft distance between the secondary transfer pairing roller 9 and the secondary transfer roller 10 changes to ct. The distance by which the secondary transfer roller 10 moves down, that is, the distance (ct−a), as a result of the sheet proceeding at this time is substantially equal to the sheet thickness.

Figure 4C:
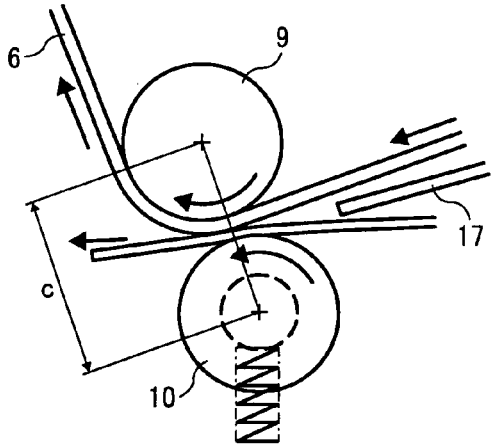

However, when a thick sheet is made to pass through the secondary transfer portion in the same manner in a state where the secondary transfer roller 10 is not pressed down, the thick sheet is not deformed along the shape of the secondary-transfer nip portion, unlike the normal sheet, because the thick sheet is more rigid, as shown in FIG. 4C. As a result, the secondary transfer roller 10 is pressed down regardless of the urging force of the spring 14, thus causing the shaft-to-shaft distance between the secondary transfer pairing roller 9 and the secondary transfer roller 10 to change to c. The distance by which the secondary transfer roller 10 moves down, that is, the distance (c−a), as a result of the sheet proceeding at this time is larger than the thickness of the thick sheet. For this reason, when a thick sheet enters, the load on the intermediate transfer belt 6 increases, and speed fluctuations of the intermediate transfer belt 6 increase accordingly.

Therefore, speed fluctuations occurring in the intermediate transfer belt 6 can be suppressed effectively by securing a space larger than the sheet thickness between the secondary transfer pairing roller 9 and the secondary transfer roller 10 before a thick sheet is made to enter the secondary transfer portion.

According to the first embodiment, the thickness of the recording sheet can be detected by a sheet-thickness detector 12 provided at a position before the recording sheet reaches the registration rollers. Based on the detection result, it is determined whether the secondary transfer roller 10 should be moved, and the moving distance is determined when the secondary transfer roller 10 is to be moved. The first embodiment need not be provided with such a detector. More specifically, the thickness of a sheet to be used can be preset by the user setting a mode on an operating unit, so that the secondary transfer roller 10 can be moved according to the mode.

When recording sheet with a thickness different from the thickness of the preceding recording sheet is detected by the sheet-thickness detector 12, it is necessary to move the secondary transfer roller 10 according to the detection result before the recording sheet reaches the secondary transfer portion. If primary transfer onto the intermediate transfer belt 6 has been started when the secondary transfer roller 10 is moved, fluctuations in the driving load of the intermediate transfer belt 6 resulting from the movement of the secondary transfer roller 10 produce speed fluctuations in the intermediate transfer belt 6, which leads to image disturbance at the primary transfer portion. In particular, when the use of a thin sheet is changed to the use of a thick sheet or the use of a thick sheet is changed to the use of a thin sheet, fluctuations in the driving load of the intermediate transfer belt 6 become considerable because the secondary transfer roller 10 is moved by a distance larger than the sheet thickness, as described above. To overcome this problem, according to the first embodiment, the following control is employed, thereby suppressing fluctuations in the driving load of the intermediate transfer belt 6 that are produced when the secondary transfer roller 10 moves towards or away from the secondary transfer pairing roller 9, thus reducing image disturbance at the primary transfer portion.

Figure 5:
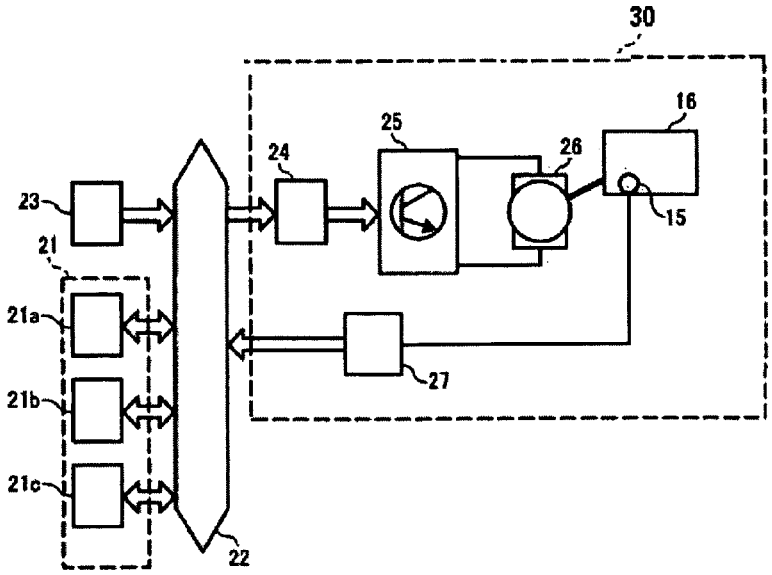
FIG. 5 is a block diagram of a control system for the movement of a secondary transfer roller and a hardware configuration to be controlled according to the first embodiment.

FIG. 5 is a block diagram of a control system for the movement of the secondary transfer roller 10 and the hardware configuration to be controlled according to the first embodiment.

The control system digitally controls the angular displacement of a direct-current (DC) motor 26 serving as the driving source that rotationally drives the moving cam 16, namely, the moving distance of the secondary transfer roller 10, based on an output signal from the secondary-transfer position detector 15 that detects the moving distance of the secondary transfer unit 13 (secondary transfer roller 10). The control system includes a microcomputer 21, a bus 22, a command-issuing device 23, a motor-driving interface unit 24, a motor-driving device 25 serving as a motor-driving unit, and a detection interface unit 27.

The microcomputer 21 includes a microprocessor 21*a*, a read only memory (ROM) 21*b*, a random access memory (RAM) 21*c*, and so forth. The microprocessor 21*a*, the ROM 21*b*, the RAM 21*c*, and so forth are interconnected via the bus 22.

The command-issuing device 23 outputs a drive-signal command value to the DC motor 26. The output side of the command-issuing device 23 is also connected to the bus 22. The drive-signal command value represents the target angular displacement (target value) at each sampling time of the moving cam 16.

The detection interface unit 27 processes output pulses from the secondary-transfer position detector 15, which includes an encoder, to convert those pulses into a digital numeric value. The detection interface unit 27 includes a counter that counts the number of output pulses from the secondary-transfer position detector 15 and obtains a digital numeric value corresponding to the angular displacement of the moving cam 16 by multiplying the count value of the counter by a predetermined constant for converting from number-of-pulses to angular-displacement. A signal for the digital numeric value corresponding to the angular displacement of the moving cam 16 is sent to the microcomputer 21 via the bus 22.

The motor-driving device 25 operates based on a pulsed control signal output from the motor-driving interface unit 24 and applies a pulsed drive voltage (PWM signal) to the DC motor 26. As a result, the amount of rotation of the DC motor 26 (i.e., the moving distance of the secondary transfer roller 10) is controlled in a moving distance pattern corresponding to a drive-signal command value output from the command-issuing device 23.

The section indicated by reference numeral 30 in FIG. 5 (also the section indicated by reference numeral 30 in FIG. 6) is a controlled section that includes the entire belt-conveyance control system shown in FIG. 1, the motor-driving interface unit 24, the motor-driving device 25, and the detection interface unit 27.

Figure 6:
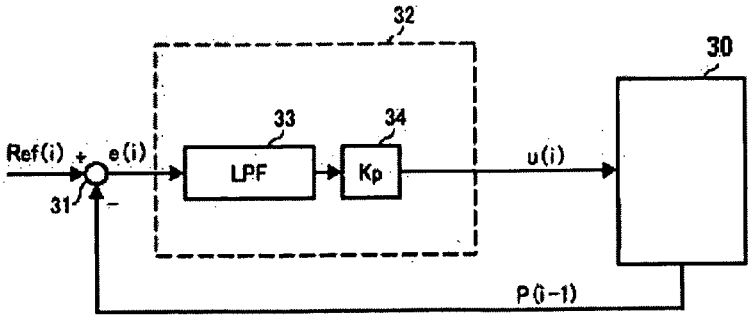
FIG. 6 is a block diagram of units for a movement control of the secondary transfer roller according to the first embodiment.

FIG. 6 is a block diagram for explaining movement control of the secondary transfer roller 10 according to the first embodiment.

The information output from the detection interface unit 27 that processes an output pulse signal from the secondary-transfer position detector 15, in other words, information P(i−1) about the moving distance of the secondary transfer roller 10 (hereinafter, referred to as the "detected moving distance"), is sent to an arithmetic unit (subtracter) 31. The arithmetic unit 31 calculates a target control value, namely, the difference e(i) between the target value Ref(i) of the moving distance of the secondary transfer roller 10 (hereinafter, referred to as the "target moving distance") and the detected moving distance P(i−1) of the secondary transfer roller 10. The difference e(i) is input to a controller 32. The controller 32 includes a low-pass filter (LPF) 33 that removes high-frequency noise and a proportional control element (gain Kp) 34. In the controller 32, a control voltage u(i) used to drive the DC motor 26 is obtained. Based on the drive voltage u(i), a drive signal is generated by the motor-driving interface unit 24 and the motor-driving device 25 and is output to the DC motor 26. The driving force of the DC motor 26, drive-controlled as described above, rotates the moving cam 16 and moves the secondary transfer roller 10 based on a predetermined target moving distance. The feedback-loop control operation described above is repeated.

The control system described above is only one example; any other control system can be used, including a PID control system, a modern control system, a robust control system, and so forth.

A procedure for setting a target moving distance will now be described.

According to the first embodiment, a target moving distance of the secondary transfer roller 10 is set so that a shock generated when driving of the secondary transfer roller 10 is started and stopped will not produce vibration in the intermediate transfer belt 6 and so that speed fluctuations of the intermediate transfer belt 6 will not be caused by a change in the pressure of the secondary transfer roller 10 onto the intermediate transfer belt 6 arising from the movement of the secondary transfer roller 10. More specifically, a target moving distance corresponding to an acceleration pattern that gives the minimum square integral of the time derivative of the acceleration of the secondary transfer roller 10 is set. Such a target moving distance can be represented by a polynomial of time.

In more detail, if a time derivative value of the acceleration of the secondary transfer roller 10 is introduced as a virtual input u', the state equation of the secondary transfer roller 10 is given by $$X = AX + Bu' \tag{1}$$

$$A = \begin{bmatrix} 0 & 1 & 0 \\ 0 & 0 & 1 \\ 0 & 0 & 0 \end{bmatrix}, B = \begin{bmatrix} 0 \\ 0 \\ 1 \end{bmatrix}, X = \begin{bmatrix} p \\ v \\ a \end{bmatrix}$$

where the symbols p, v, and α represent the displacement, the velocity, and the acceleration, respectively, of the secondary transfer roller 10.

An estimation function J for calculating a target moving distance corresponding to an acceleration pattern that gives the minimum square integral of the time derivative of the acceleration of the secondary transfer roller 10 is represented by Equation (2) below if movement occurs from time 0 to T.

$$J = \int_0^T u'^2 dt \tag{2}$$

A target displacement (moving distance) of the secondary transfer roller 10 that gives the smallest estimation function J can be represented by a fifth-order polynomial of time. In short, if $C_0$ to $C_5$ are constants, a target moving distance Rp1 of the secondary transfer roller 10 is represented by $$Rp1 = C_5 \times t^5 + C_4 \times t^4 + C_3 \times t^3 + C_2 \times t^2 + C_1 \times t + C_0 \tag{3}$$

In the above state equation, initial conditions and terminal conditions of the secondary transfer roller 10 to be controlled are given by $$X(0) = \begin{bmatrix} 0 \\ 0 \\ 0 \end{bmatrix}, X(T) = \begin{bmatrix} P1 \\ 0 \\ 0 \end{bmatrix} \tag{4}$$

where P1 represents the moving distance of the secondary transfer roller 10, and T represents the target moving time from when the secondary transfer roller 10 starts to move to when the secondary transfer roller 10 stops moving.

From the description so far, the target moving distance Rp of the secondary transfer roller 10 is represented by $$Rp = 6a_{16}t^5 + 5a_{15}t^4 + 4a_{14}t^3 \tag{5}$$

$$\begin{bmatrix} a_{16} \\ a_{15} \\ a_{14} \end{bmatrix} = \begin{bmatrix} 6T^5 & 5T^4 & 4T^3 \\ 30T^4 & 20T^3 & 12T^2 \\ 120T^3 & 60T^2 & 24T \end{bmatrix} \cdot \begin{bmatrix} P1 \\ 0 \\ 0 \end{bmatrix}$$

Based on the equation derived above, a target moving distance is obtained at each sampling time in the microcomputer 21 to drive the DC motor 26 so that the DC motor 26 follows the obtained target moving distance. With such a control technique, not only can the intermediate transfer belt 6 be made free from vibration but also speed fluctuations of the intermediate transfer belt 6 arising from a change in the pressure at the secondary transfer portion can be prevented from occurring.

The control method described above has a disadvantage in that it is computationally intensive because this control method generally involves calculation of an inverse matrix to obtain coefficients of a polynomial of time for a target value. In other words, with the above equation as-is, an inverse matrix needs to be calculated to obtain the coefficients of the polynomial, which requires complicated calculations. To overcome this problem, an alternative method is employed. More specifically, the polynomial involving sampling time t for the target angular displacement Rp is converted as follows by using the value obtained by dividing the target moving time from 0 (start of movement) to P1 by T. In short, the polynomial Rp involving time t for the target angular displacement is given by Equation (6). Based on the equation derived above, a target moving distance may be obtained at each sampling time in the microcomputer 21 to drive the DC motor 26 so that the DC motor 26 follows the obtained target moving distance.

$$Rp = 60P1\left\{\frac{1}{10}\left(\frac{t}{T}\right)^5 - \frac{1}{4}\left(\frac{t}{T}\right)^4 - \frac{1}{6}\left(\frac{t}{T}\right)^3\right\} \tag{6}$$

Figure 7:
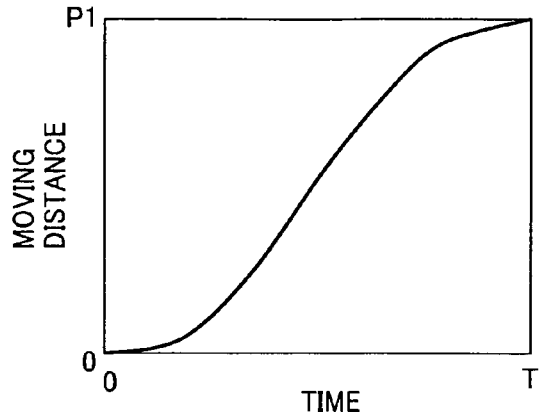
FIG. 7 is a graph of one example of a target moving distance according to the first embodiment.

FIG. 7 is a graph of one example of target moving distance of the secondary transfer roller 10 obtained based on the above equation. FIG. 7 shows exemplary target moving distance of the secondary transfer roller 10 when changing from feeding a thick sheet to feeding a thin sheet. Feeding a thick sheet refers to the state in which the secondary transfer roller 10 is moved down by a certain distance corresponding to the sheet thickness as a result of the secondary transfer unit 13 being pressed down by rotating the moving cam 16 shown in FIG. 1 by a certain amount from the state in which the moving cam 16 is in contact with the contact portion 13*b* of the secondary transfer unit 13. On the other hand, feeding a thin sheet refers to the state in which the moving cam 16 is out of contact with the contact portion 13*b* of the secondary transfer unit 13 to allow the secondary transfer roller 10 to be pressed in contact with the intermediate transfer belt 6 by means of the spring 14. In FIG. 7, the vertical axis "MOVING DISTANCE" indicates the moving distance of the secondary transfer roller 10. Therefore, "P1" on the vertical axis indicates a certain moving distance of the secondary transfer roller 10 within the period of time from when the thick sheet is fed to when the thin sheet is fed. On the other hand, the horizontal axis "TIME" indicates the period of time required for the secondary transfer roller 10 to move the above-described predetermined amount of pressing. Therefore, "T" on the horizontal axis indicates the period of time required to move the secondary transfer roller 10 from the state in which the thick sheet is fed to the state in which the thin sheet is fed, namely, the time at which the movement of the secondary transfer roller 10 stops.

As shown in FIG. 7, the target moving distance of the secondary transfer roller 10 is set such that, when the secondary transfer roller 10 is pressed down by a certain distance corresponding to the thickness of the sheet being fed, a change in the acceleration of the secondary transfer roller 10 is minimized over the period of time from when the secondary transfer roller 10 starts to move for feeding of the thin sheet to when the secondary transfer roller 10 completes the movement. By doing so, the degree of speed fluctuation of the intermediate transfer belt 6 due to vibration resulting from the movement of the secondary transfer roller 10 can be reduced.

Figure 8:
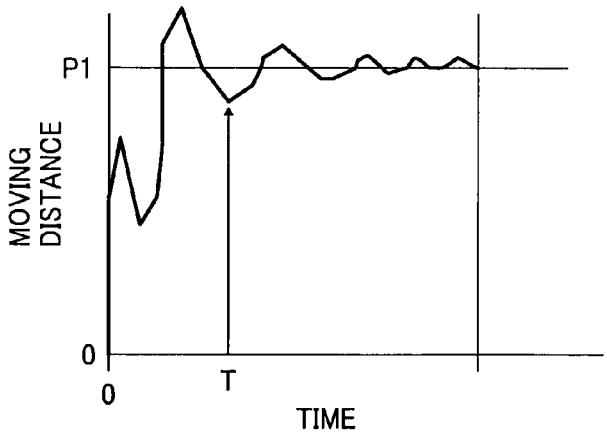
FIG. 8 is a graph of a detected moving distance of a secondary transfer roller according to a conventional technology without performing a feedback control on the movement of the secondary transfer roller.

FIG. 8 is a graph of a change in moving distance of the secondary transfer roller 10 in a case where feedback drive control of the moving cam 16 is not carried out using the target control value derived from the target moving distance of the secondary transfer roller 10 shown in FIG. 7, namely, in a case where the secondary transfer roller 10 is moved in a single stroke to the position for feeding a thin sheet from the state in which the secondary transfer roller 10 is pressed down by a predetermined distance for feeding a thick sheet (in a case where the moving cam 16 is rotated to the position where the secondary transfer roller 10 is in contact with the intermediate transfer belt 6 by means of the spring 14 alone from the state in which the moving cam 16 is pressed against the contact portion 13*b* of the secondary transfer unit 13). In FIG. 8, the vertical axis represents the moving distance of the secondary transfer roller 10, and the horizontal axis represents the time required for the secondary transfer roller 10 to move. As is apparent from FIG. 8, if feedback control by the use of the target movement value shown in FIG. 7 is not carried out, the moving distance of the secondary transfer roller 10 fluctuates not only during the period of time from when the secondary transfer roller 10 starts to move to when the secondary transfer roller 10 stops moving (until time T), but also after the secondary transfer roller 10 has stopped moving (after time T). Because the secondary transfer roller 10 is urged by the spring 14 as described above, a fluctuation in the moving distance of the secondary transfer roller 10 directly leads to a change in the pressure of the secondary transfer roller 10 onto the intermediate transfer belt 6. Therefore, such a change in the pressure acts upon the intermediate transfer belt 6 as fluctuations in the driving load. These fluctuations in the driving load result in speed fluctuations of the intermediate transfer belt 6, and if imaging is being performed at the primary transfer portion at this time, these speed fluctuations of the intermediate transfer belt 6 cause image disturbance such as color misalignment.

Figure 9:
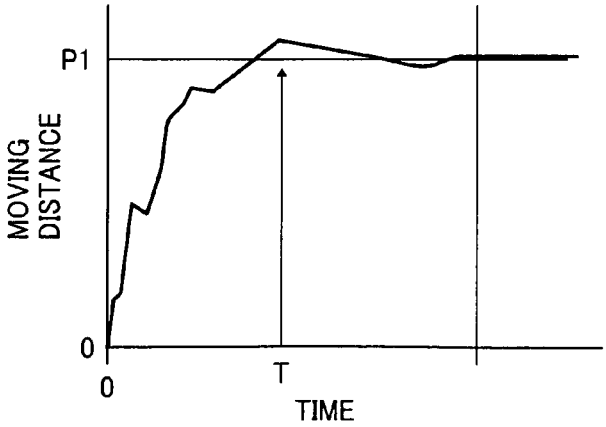
FIG. 9 is a graph of a detected moving distance of the secondary transfer roller according to the first embodiment.

On the other hand, FIG. 9 is a graph of a change in moving distance of the secondary transfer roller 10 in a case where feedback drive control of the moving cam 16 is carried out using the target control value derived from the target moving distance of the secondary transfer roller 10 shown in FIG. 7, namely, in a case where the secondary transfer roller 10 is moved to the position for feeding a thin sheet following the target movement value of FIG. 7 from the state in which the secondary transfer roller 10 is pressed down by a predetermined distance for feeding a thick sheet (in a case where the moving cam 16 is rotationally drive-controlled using the target control value derived from the target moving distance of the secondary transfer roller 10 in FIG. 7). As is apparent from FIG. 9, the fluctuation in the moving distance of the secondary transfer roller 10 seen in FIG. 8 is reduced significantly.

Thus, according to the first embodiment, because fluctuations in the driving load of the intermediate transfer belt 6 resulting from the movement of the secondary transfer roller 10 are suppressed, speed fluctuations of the intermediate transfer belt 6 can be reduced. This makes it possible to suppress image disturbance at the primary transfer portion.

As described above, according to the first embodiment, degradation in image quality can be suppressed because fluctuations in the driving load caused by vibration of the intermediate transfer belt 6 resulting from the movement of the secondary transfer roller 10 can be reduced. Nevertheless, the movement of the secondary transfer roller 10 produces fluctuations, though not oscillatory, in the pressure of the secondary transfer roller 10 onto the intermediate transfer belt 6. These fluctuations act as load fluctuations in the transfer belt. Although, in general, these fluctuations can be suppressed through feedback drive control of the intermediate transfer belt 6, the fluctuation suppressing effect is limited to a certain degree because of a problem associated with responsiveness. With this being the situation, a second embodiment of the present invention employs a technique for presetting load fluctuations that are produced in the intermediate transfer belt 6 when the secondary transfer roller 10 moves based on the target movement value of the secondary transfer roller 10 according to the first embodiment. An intermediate-transfer-belt drive-control system is constructed so that the load fluctuations that are produced in the intermediate transfer belt 6 are converted into a motor-driving current, which is added to the motor-driving current of the intermediate transfer belt 6 as the amount of feedforward. By doing so, higher-accuracy driving of the intermediate transfer belt 6 is carried out to more effectively suppress degradation in image quality. The basic structure and the operation of the copier according to the second embodiment are substantially the same as those of the copier according to the first embodiment, and therefore, a detailed description thereof will be omitted. The second embodiment mainly focuses on differences from the first embodiment.

Figure 10:
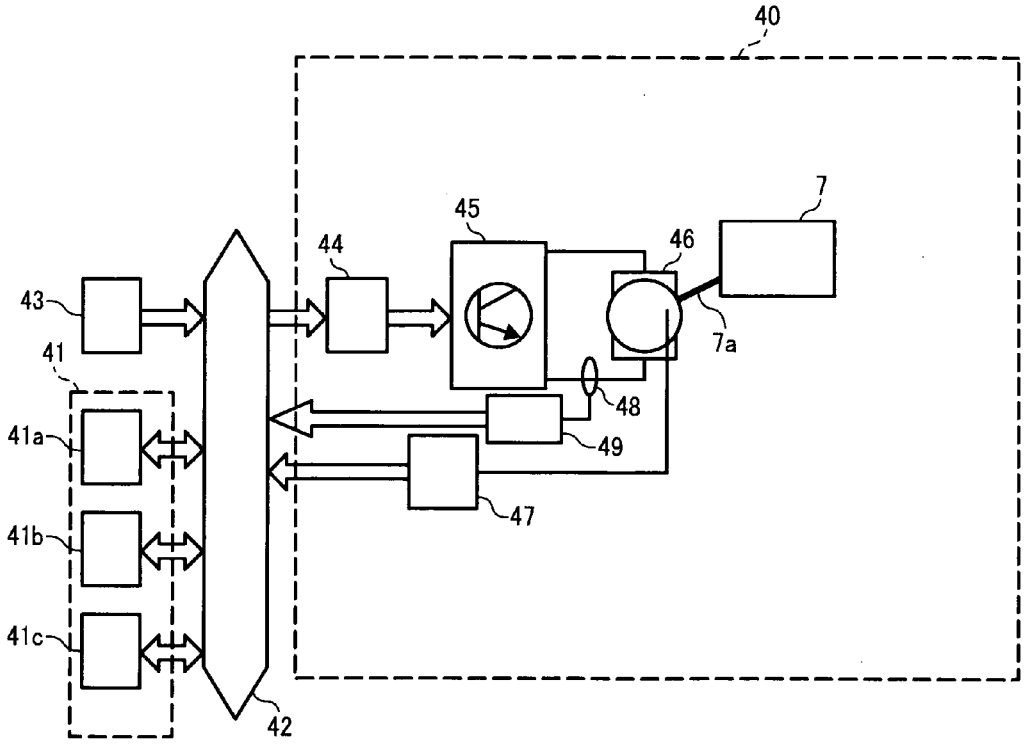
FIG. 10 is a block diagram of a drive-control system of an intermediate transfer belt and a hardware configuration to be controlled according to a second embodiment of the present invention.

FIG. 10 is a block diagram of the drive-control system of the intermediate transfer belt 6 and the hardware configuration to be controlled according to the second embodiment.

The control system controls the angular velocity of a drive motor connected to the belt-driving roller 7 having the intermediate transfer belt 6 looped thereover with a signal from an encoder mounted on the motor. The control system includes a microcomputer 41, a bus 42, a command-issuing device 43, a motor-driving interface unit 44, a motor-driving device 45, and a detection interface unit 47. The microcomputer 41 includes a microprocessor 41*a*, a ROM 41*b*, a RAM 41*c*, and so forth. The microprocessor 41*a*, the ROM 41*b*, the RAM 41*c*, and so forth are interconnected via the bus 42.

The command-issuing device 43 outputs a drive-signal command value to a DC motor 46. The output side of the command-issuing device 43 is also connected to the bus 42. The detection interface unit 47 processes output pulses from the encoder and converts them into a digital numeric value. The detection interface unit 47 counts the output pulse intervals of the encoder using pulses with a shorter period to calculate the angular velocity of the motor. A signal representing the digital numeric value is sent to the microcomputer 41 via the bus 42. An electrical current flowing into the DC motor 46 is detected by a current-detecting device 48 and is sent to the microcomputer 41 via an A/D conversion device 49. The motor-driving device 45 operates based on a pulsed control signal output from the motor-driving interface unit 44 and applies a pulsed drive voltage (PWM signal) to the DC motor 46. As a result, the rotational speed of the DC motor 46, namely, the movement speed of the intermediate transfer belt 6, is drive-controlled in a predetermined moving speed pattern output from the command-issuing device 43.

The DC motor 46 and the belt-driving roller 7 of the intermediate transfer belt 6 are mechanically connected via a speed reducer 7*a* (not shown in the figure).

The section indicated by reference numeral 40 in FIG. 10 (also the section indicated by reference numeral 40 in FIG. 11) is a controlled section that includes the entire belt-conveyance control system shown in FIG. 1, the motor-driving interface unit 44, the motor-driving device 45, the detection interface unit 47, the current-detecting device 48, and the A/D conversion device 49.

Figure 11:
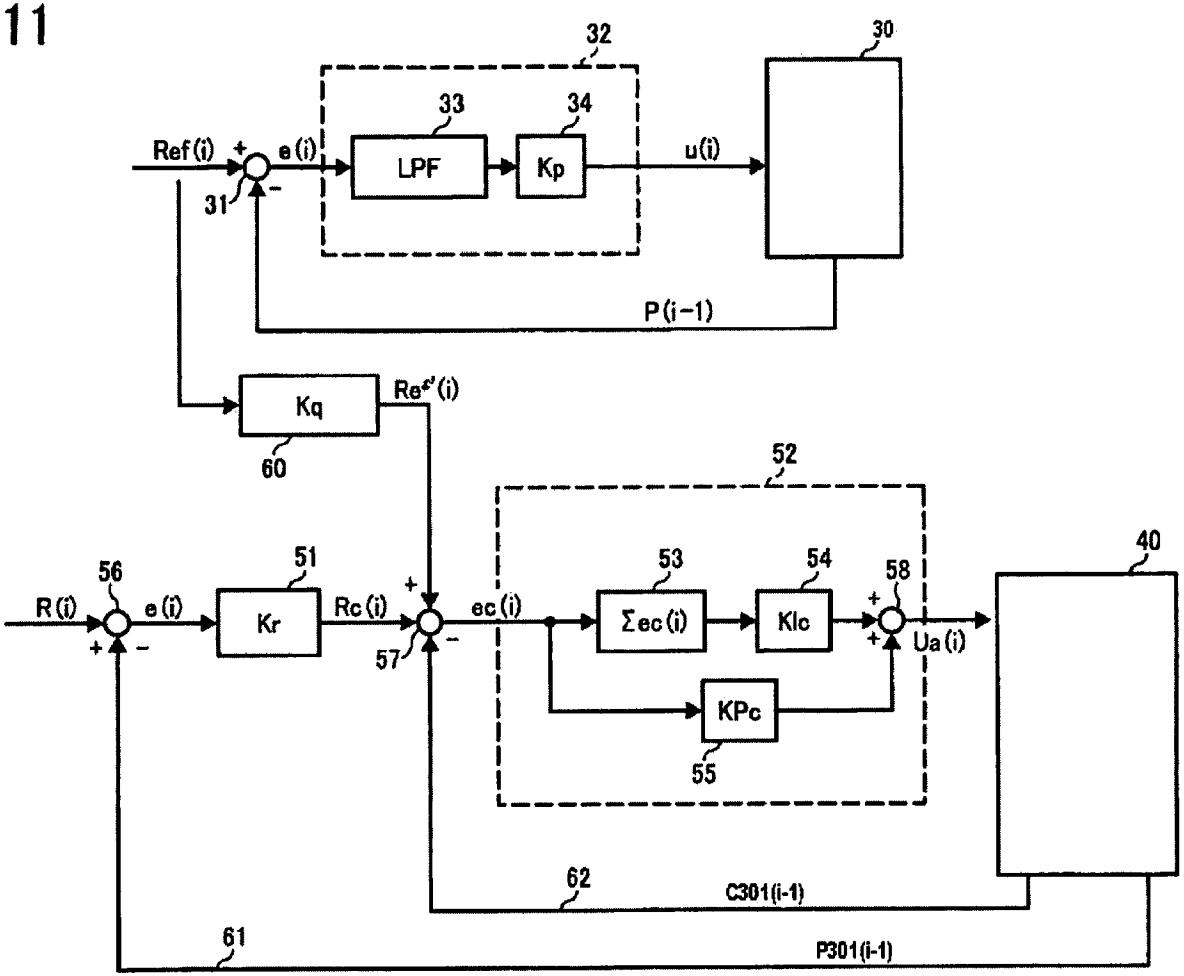
FIG. 11 is a block diagram of units for a movement control of a secondary transfer roller and a speed control of an intermediate transfer belt according to the second embodiment.

FIG. 11 is a block diagram for explaining movement control of the secondary transfer roller 10 and speed control of the intermediate transfer belt 6 according to the second embodiment.

Because the movement control system of the secondary transfer roller 10 is substantially the same as the one shown in FIG. 6 in the first embodiment, the components with the same reference numerals as those in FIG. 6 are denoted with the same reference numerals, and thus a detailed description thereof will be omitted.

The output from the detection interface unit 47 that processes the output from the motor encoder, namely, an angular velocity P301(i−1) of the drive motor of the intermediate transfer belt 6, is sent to an arithmetic unit 56 via a loop 61. The arithmetic unit 56 calculates the difference e(i) between an angular-velocity command signal R(i), which is the target control value output from the command-issuing device 43, and the angular velocity P301(i−1) from the loop 61. The difference e(i) is input to a controller block 51. Arithmetic operations for control are performed in the controller block 51 to calculate a target current RC(i), which is sent to an arithmetic unit 57. At the same time, a motor-driving current C301(i−1) that is detected by the current-detecting device 48 and sent to the microcomputer 41 via the A/D conversion device 49 is sent to the arithmetic unit 57 via a loop 62.

According to the second embodiment, a motor fluctuation current Ref(i−1) corresponding to load fluctuations of the intermediate transfer belt 6 calculated from the target moving distance Ref(i) of the secondary transfer roller 10 in the movement control system of the secondary transfer roller 10 is sent to the arithmetic unit 57. A converting unit 60 is responsible for the conversion and, specifically, converts the input target moving distance Ref(i) of the secondary transfer roller 10 into a motor fluctuation current Ref'(i) corresponding to load fluctuations that are produced in the driving system of the intermediate transfer belt 6 when the secondary transfer roller 10 is moved by that target moving distance. The converting unit 60 is provided with a transformation coefficient Kq representing the correspondence between the target moving distance Ref(i) and the motor fluctuation current Ref'(i), so that the motor fluctuation current is obtained by multiplying the target moving distance by the transformation coefficient Kq. The conversion equation and a correspondence table can be produced easily from experiments. One example for obtaining such a conversion equation and a correspondence table is described below.

Because the secondary transfer roller 10 is supported by the spring 14, as shown in FIG. 1, when the position of the secondary transfer roller 10 is determined, the force calculated from "the position.times.the spring constant" is applied to the secondary transfer roller 10, and this force is applied to the intermediate transfer belt 6 as a force pressing the secondary transfer roller 10 onto the intermediate transfer belt 6. This force is the load on the intermediate transfer belt 6. Therefore, when the position of the secondary transfer roller 10 changes, the force applied to the secondary transfer roller 10 changes, and the force pressing the secondary transfer roller 10 onto the intermediate transfer belt 6 changes accordingly. This produces load fluctuations in the intermediate transfer belt 6. In other words, a proportional relationship holds between the moving distance of the secondary transfer roller 10 and load fluctuations of the intermediate transfer belt 6. These load fluctuations are controlled with a driving current, and because load fluctuations and a motor current necessary to control those fluctuations are in a proportional relationship, a proportional relationship also holds between the moving distance of the secondary transfer roller 10 and the motor current. The moving distance of the secondary transfer roller 10 is controlled to become the target moving distance. Therefore, a proportional relationship also holds between the target moving distance of the secondary transfer roller 10 and the motor fluctuation current. Based on this fact, the secondary transfer roller 10 is actually moved by a particular amount relative to the intermediate transfer belt 6 to detect how much the motor-driving current of the intermediate transfer belt 6 changes as a result of the movement of the secondary transfer roller 10. For example, a transformation coefficient can be obtained by gradually increasing the motor-driving current of the intermediate transfer belt 6 while the secondary transfer roller 10 is immobilized at a predetermined position and then detecting the current just before the intermediate transfer belt 6 starts to move. The arithmetic unit 57 then calculates a value ec(i), which is obtained by adding the motor fluctuation current Ref(i) to the difference between the motor target current RC(i) of the intermediate transfer belt 6 and the motor-driving current C301(i−1) from the loop 62.

The value ec(i) output from the arithmetic unit 57 is input to a current controller 52. The current controller 52 is realized by, for example, a PI control system. The value ec(i) calculated in the arithmetic unit 57 is integrated in the block 53 and multiplied by a constant KIc in a block 54, and the resultant value is sent to the arithmetic unit 58. Furthermore, the value ec(i) calculated in the arithmetic unit 57 is multiplied by a constant KPc in a block 55, and the resultant value is sent to the arithmetic unit 58. The arithmetic unit 58 adds the two input signals from the blocks 54 and 55 to obtain a motor control voltage Ua(i). The control voltage Ua(i) obtained in the arithmetic unit 58 is output to the DC motor 46 via the motor-driving interface unit 44 and the motor-driving device 45. The loop operation described above is repeated in this manner.

Advantages of the second embodiment will be described with reference to FIGS. 12A and 12B.

Figure 12B:
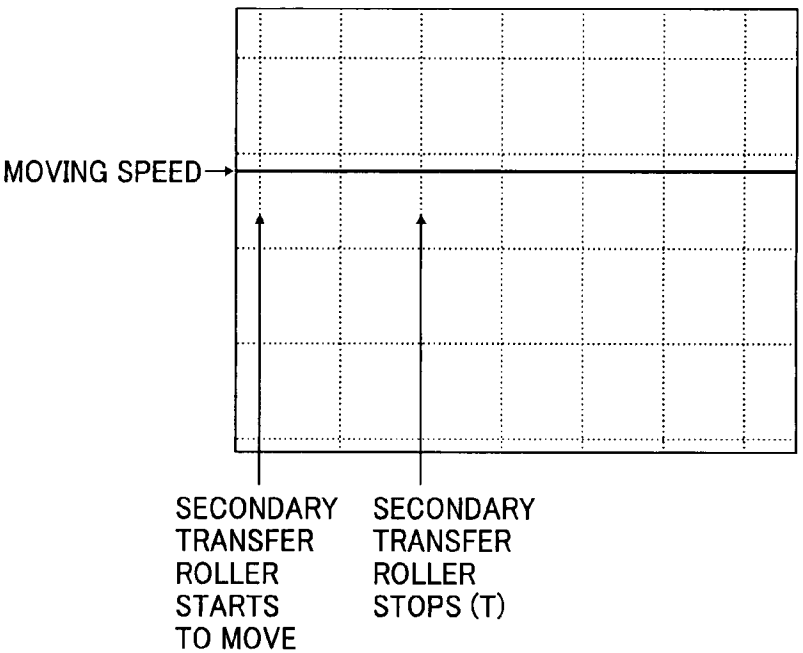
FIG. 12B is a graph of speed fluctuations of an intermediate transfer belt in a case where the intermediate transfer belt is subjected to a feedforward control.
Figure 12A:
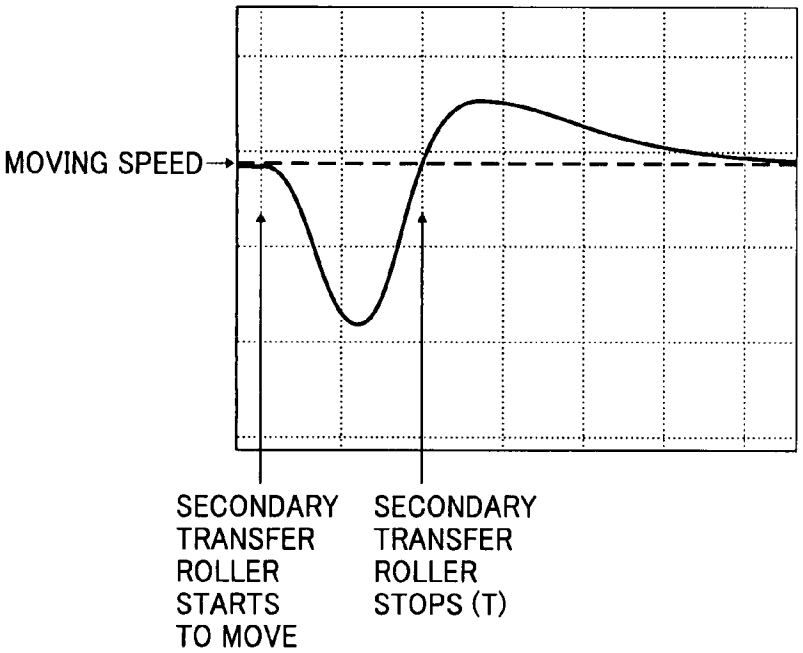
FIG. 12A is a graph of speed fluctuations of an intermediate transfer belt in a case where the intermediate transfer belt is not subjected to a feedforward control.

FIGS. 12A and 12B are graphs of speed fluctuations of the intermediate transfer belt 6 resulting from the movement of the secondary transfer roller 10. FIG. 12A is a graph of speed fluctuations of the intermediate transfer belt 6 in a case where feedforward control of the intermediate transfer belt 6 described in the second embodiment is not carried out. In other words, the graph represents speed fluctuations of the intermediate transfer belt 6 in a case where the secondary transfer roller 10 is moved only based on the target moving distance of the secondary transfer roller 10 shown in FIG. 7 according to the first embodiment.

On the other hand, FIG. 12B is a graph of speed fluctuations of the intermediate transfer belt 6 in a case where feedforward control of the intermediate transfer belt 6 described in the second embodiment is carried out. In other words, the graph represents speed fluctuations of the intermediate transfer belt 6 in a case where feedforward control is applied to the intermediate transfer belt 6 using the motor fluctuation current of the intermediate transfer belt 6 calculated based on the target moving distance of the secondary transfer roller 10, in addition to the movement of the secondary transfer roller 10 based on the target moving distance of the secondary transfer roller 10 shown in FIG. 7 according to the first embodiment.

Referring to FIG. 12A, speed fluctuations are seen, these fluctuations being produced by load fluctuations occurring in the intermediate transfer belt 6 resulting from the movement of the secondary transfer roller 10 within the period of time from when the secondary transfer roller 10 starts to move to when the secondary transfer roller 10 stops moving. Furthermore, in an attempt to control those speed fluctuations within the period of time from when the secondary transfer roller 10 starts to move to when the secondary transfer roller 10 stops moving, another speed fluctuation is produced in the intermediate transfer belt 6 even after the secondary transfer roller 10 has stopped moving.

Referring to FIG. 12B, on the other hand, speed fluctuations of the intermediate transfer belt 6 resulting from the movement of the secondary transfer roller 10 are markedly suppressed via feedforward control. More specifically, speed fluctuations are barely seen not only within the period of time from when the secondary transfer roller 10 starts to move to when the secondary transfer roller 10 stops moving but also after the secondary transfer roller 10 has stopped moving.

As described above, according to the second embodiment, degradation in image quality can be effectively suppressed not only because fluctuations in the driving load of the intermediate transfer belt 6 due to vibrations resulting from the movement of the secondary transfer roller 10 can be suppressed, but also because speed fluctuations of the intermediate transfer belt 6 due to fluctuations in the pressure resulting from the movement of the secondary transfer roller 10 can be controlled by applying feedforward control to the motor of the intermediate transfer belt 6 based on a motor fluctuation current of the intermediate transfer belt 6 corresponding to the target moving distance of the secondary transfer roller 10.

According to the second embodiment, the current controller 52 is realized by a PI control system as one example; however, the current controller 52 is not limited to a PI control system. All the arithmetic operations described above are carried out as numeric arithmetic operations in the microcomputer 41 and can be implemented easily; however, those arithmetic operations are not limited to digital processing but can be implemented on an analog system.

The first and second embodiments have been described by way of an example where a thin sheet enters after a thick sheet has exited. A description of the operation in a case where a thick sheet enters after a thin sheet has exited is omitted because it is substantially the same as the case where a thin sheet enters after a thick sheet has exited, except for the movement direction of the secondary transfer roller 10.

Figure 13:
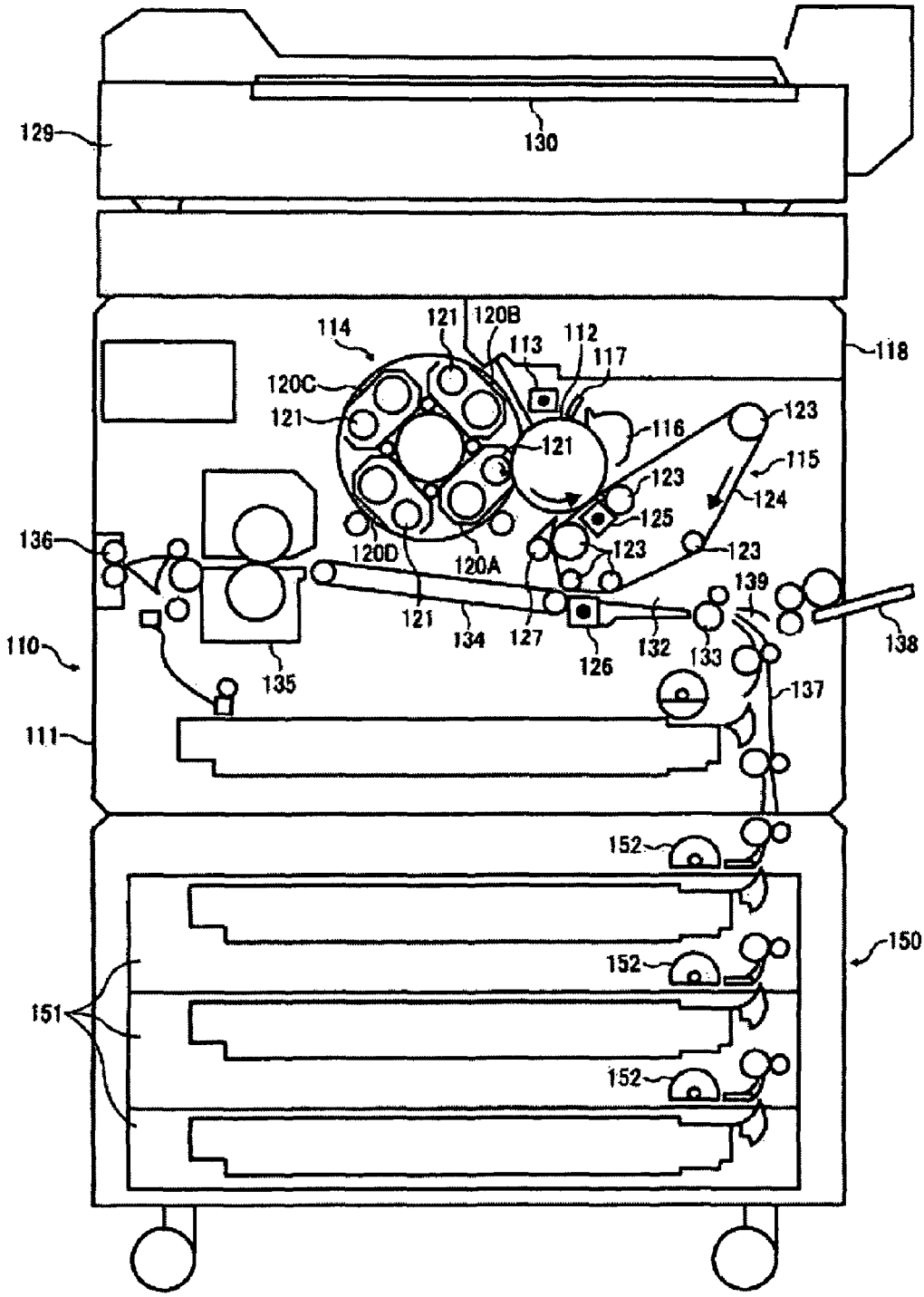
FIG. 13 is a schematic diagram of a color copier serving as an image forming apparatus according to a third embodiment of the present invention.

FIG. 13 is a schematic diagram of a color copier serving as an image forming apparatus according to a third embodiment of the present invention.

Referring to FIG. 13, an apparatus main body 110 of the color copier according to the third embodiment contains a drum-shaped photosensitive member (hereinafter, referred to as the "photosensitive drum") 112, serving as a latent-image carrier, which is disposed slightly to the right of center in an outer casing 111 thereof. Around the photosensitive drum 112, a charger 113 disposed thereabove, a rotational developing device 114 serving as a developing unit, an intermediate transfer unit 115, a cleaning device 116, a discharger 117, and so forth are disposed in that order along the rotation direction indicated by the arrow (counterclockwise).

A photo-writing apparatus serving as an exposure unit, such as a laser-writing device 118, is disposed above the charger 113, the rotational developing device 114, the cleaning device 116, and the discharger 117. The rotational developing device 114 includes developers 120A, 120B, 120C, and 120D each having a developing roller 121. The developers 120A, 120B, 120C, and 120D contain yellow, magenta, cyan, and black toners, respectively. The rotational developing device 114 rotates about a neutral axis to selectively move the developers 120A, 120B, 120C, and 120D for the respective colors to a developing position facing the outer circumference of the photosensitive drum 112.

In the intermediate transfer unit 115, an intermediate transfer belt 124 serving as an intermediate transfer body, which is an image carrier, is looped over a plurality of rollers 123, and the intermediate transfer belt 124 is brought into contact with the photosensitive drum 112. A transfer apparatus 125 is disposed on the inner side of the intermediate transfer belt 124, and a transfer apparatus 126 and a cleaning device 127 are disposed on the outer side of the intermediate transfer belt 124. The cleaning device 127 is provided so that it can move towards and away from the intermediate transfer belt 124.

The laser-writing device 118 receives an image signal for each color from an image-reading apparatus 129 via an image-processing unit (not shown in the figure). Thereafter, the uniformly charged photosensitive drum 112 is irradiated with laser light L sequentially modulated with an image signal for each color to expose the photosensitive drum 112, thus forming an electrostatic latent image on the photosensitive drum 112. The image-reading apparatus 129 reads, on a per-color basis, the image of an original document G set on a document glass plate 130 provided on the upper surface of the apparatus main body 110 and converts the image into an electrical image signal. A recording-medium conveying path 132 conveys a recording medium such as recording sheet from right to left. A registration roller 133 is disposed in the recording-medium conveying path 132 towards the front side from the intermediate transfer unit 115 and the transfer apparatus 126. Furthermore, a conveyor belt 134, a fixing unit 135, and sheet-ejecting rollers 136 are disposed downstream of the intermediate transfer unit 115 and the transfer apparatus 126.

The apparatus main body 110 is disposed on a sheet-supply apparatus 150. A plurality of sheet-supply cassettes 151 are stacked one above another in the sheet-supply apparatus 150, so that one of a plurality of sheet-feed rollers 152 is selectively driven to send a recording medium from the corresponding sheet-supply cassette 151. The recording medium is conveyed to the recording-medium conveying path 132 through an automatic feed path 137 in the apparatus main body 110. A manual-feed tray 138 is provided on the right side of the apparatus main body 110. The recording medium inserted from the manual-feed tray 138 is conveyed to the recording-medium conveying path 132 through a manual-feed path 139 in the apparatus main body 110. A sheet output tray (not shown in the figure) is attachably/detachably mounted on the left side of the apparatus main body 110, and the recording medium ejected by the sheet-ejecting rollers 136 through the recording-medium conveying path 132 is stacked on the sheet output tray.

In the color copier according to the third embodiment, when color copying is to be performed, the original document G is set on the document glass plate 130, and a start switch (not shown in the figure) is pressed to start the copying operation. First, the image-reading apparatus 129 reads, on a per-color basis, the image of the original document G on the document glass plate 130. At the same time, the recording medium is selectively sent from one of the sheet-supply cassettes 151 in the sheet-supply apparatus 150 by means of the corresponding sheet-feed roller 152. The recording medium passes through the automatic feed path 137 and the recording-medium conveying path 132 and is blocked by the registration roller 133.

The photosensitive drum 112 rotates counterclockwise, and the intermediate transfer belt 124 rotates clockwise by the rotation of the driving roller from among the rollers 123. Along with this rotation, the photosensitive drum 112 is uniformly charged by the charger 113. The laser-writing device 118 receives an image signal for the first color from the image-reading apparatus 129 via the image-processing unit and emits laser light modulated with the image signal to form an electrostatic latent image on the photosensitive drum 112.

The electrostatic latent image on the photosensitive drum 112 is developed by the developer 120A for the first color of the rotational developing device 114 to become an image for the first color, and the image for the first color on the photosensitive drum 112 is transferred onto the intermediate transfer belt 124 by the transfer apparatus 125. After the image for the first color has been transferred, the photosensitive drum 112 is cleaned by the cleaning device 116 to remove remaining toner and is then discharged by the discharger 117.

Subsequently, the photosensitive drum 112 is uniformly charged by the charger 113. The laser-writing device 118 receives an image signal for the second color from the image-reading apparatus 129 via the image-processing unit and emits laser light modulated with the image signal to form an electrostatic latent image on the photosensitive drum 112. The electrostatic latent image on the photosensitive drum 112 is developed by the developer 120B for the second color of the rotational developing device 114 to become an image for the second color. The image for the second color on the photosensitive drum 112 is transferred onto the intermediate transfer belt 124 by the transfer apparatus 125 such that it overlays the image for the first color. After the image for the second color has been transferred, the photosensitive drum 112 is cleaned by the cleaning device 116 to remove remaining toner and is then discharged by the discharger 117.

Next, the photosensitive drum 112 is uniformly charged by the charger 113. The laser-writing device 118 receives an image signal for the third color from the image-reading apparatus 129 via the image-processing unit and emits laser light modulated with the image signal to form an electrostatic latent image on the photosensitive drum 112. The electrostatic latent image on the photosensitive drum 112 is developed by the developer 120C for the third color of the rotational developing device 114 to become an image for the third color. The image for the third color on the photosensitive drum 112 is transferred onto the intermediate transfer belt 124 by the transfer apparatus 125 such that it overlays the images for the first and second colors. After the image for the third color has been transferred, the photosensitive drum 112 is cleaned by the cleaning device 116 to remove remaining toner and is then discharged by the discharger 117.

Furthermore, the photosensitive drum 112 is uniformly charged by the charger 113. The laser-writing device 118 receives an image signal for the fourth color from the image-reading apparatus 129 via the image-processing unit and emits laser light modulated with the image signal to form an electrostatic latent image on the photosensitive drum 112. The electrostatic latent image on the photosensitive drum 112 is developed by the developer 120D for the fourth color of the rotational developing device 114 to become an image for the fourth color. The image for the fourth color on the photosensitive drum 112 is transferred onto the intermediate transfer belt 124 by the transfer apparatus 125 such that it overlays the images for the first, second, and third colors to form a full-color image. After the image for the fourth color has been transferred, the photosensitive drum 112 is cleaned by the cleaning device 116 to remove remaining toner and is then discharged by the discharger 117.

Thereafter, the registration roller 133 rotates with an appropriate timing to send the recording medium onto which the full-color image on the intermediate transfer belt 124 will be transferred by the transfer apparatus 126. The recording medium is conveyed by means of the conveyor belt 134, the full-color image is fixed onto the recording medium by the fixing unit 135, and the recording medium is finally ejected to the sheet output tray by the sheet-ejecting rollers 136. After the full-color image has been transferred, the intermediate transfer belt 124 is cleaned by the cleaning device 127 to remove remaining toner.

An operating procedure for forming a four-color overlaid image has been described above. When a three-color overlaid image is to be formed, three different monochrome images are sequentially formed on the photosensitive drum 112 and transferred onto the intermediate transfer belt 124 in an overlapping manner. Thereafter, the monochrome images are transferred onto the recording medium all at once. When a two-color overlaid image is to be formed, two different monochrome images are sequentially formed on the photosensitive drum 112, transferred onto the intermediate transfer belt 124 in an overlapping manner, and transferred onto the recording medium all at once. When a monochrome image is to be formed, one monochrome image is formed on the photosensitive drum 112, transferred onto the intermediate transfer belt 124, and then transferred onto the recording medium.

In the copier according to the third embodiment, until the image for the final color is transferred onto the intermediate transfer belt 124, the cleaning device 127 serving as a moving member is placed out of contact with the surface of the intermediate transfer belt 124 so that the image transferred onto the intermediate transfer belt 124 is not distorted. The cleaning device 127 is brought into contact with the surface of the intermediate transfer belt 124 before the front end of the belt bearing the full-color image that has been subjected to secondary transfer reaches the cleaning position. When the cleaning device 127 is to be moved, image transfer is in progress at the primary transfer portion, which is the portion facing the photosensitive drum 112 and the intermediate transfer belt 124. Therefore, the movement of the cleaning device 127 produces fluctuations in the driving load of the intermediate transfer belt 124, which causes speed fluctuations of the intermediate transfer belt 124, resulting in image distortion at the primary transfer portion. Degradation in image quality occurs in this manner.

To overcome this problem, according to the third embodiment, movement of the cleaning device 127 is controlled in the same manner as with the movement control of the secondary transfer roller 10 according to the first and second embodiments. By doing so, because fluctuations in the driving load of the intermediate transfer belt 124 resulting from the movement of the cleaning device 127 can be reduced, degradation in image quality caused by speed fluctuations of the intermediate transfer belt 124 can be suppressed.

Furthermore, if movement control alone of the cleaning device 127 cannot sufficiently suppress degradation in image quality, drive control of the intermediate transfer belt 124 may further be performed so as to suppress speed fluctuations of the intermediate transfer belt 124 resulting from the movement of the cleaning device 127 by using the target moving distance of the cleaning device 127, as described in the second embodiment.

Figure 14:
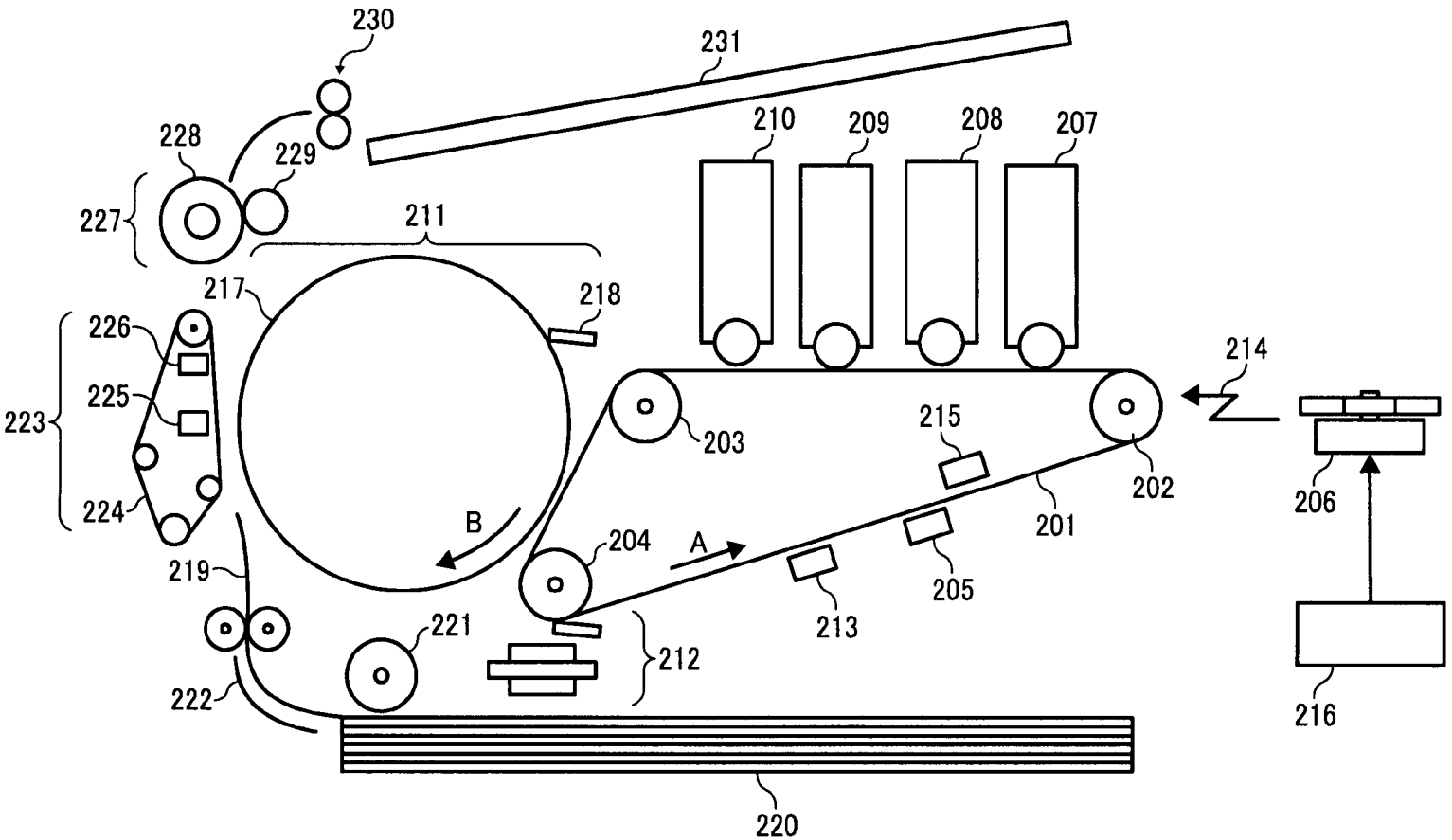
FIG. 14 is a schematic diagram of a color copier serving as an image forming apparatus according to a fourth embodiment of the present invention.

FIG. 14 is a schematic diagram of a color copier serving as an image forming apparatus according to a fourth embodiment of the present invention.

Referring to FIG. 14, a photosensitive member belt 201 serving as a latent-image carrier is an endless photosensitive member belt manufactured by forming a thin photosensitive layer, such as an organic optical semiconductor (OPC), on the outer circumferential surface of an NL belt base material formed in a closed loop. The photosensitive member belt 201 is supported by three photosensitive-member conveying rollers 202 to 204 serving as rotating supports and rotates in the direction indicated by arrow A by means of a drive motor (not shown in the figure).

A charger 205; an exposure optical system (hereinafter, referred to as the "LSU") 206 serving as an exposure unit; developers 207 to 210 for the colors black, yellow, magenta, and cyan, respectively; an intermediate transfer unit 211; a photosensitive-member cleaning unit 212; and a discharger 213 are disposed around the photosensitive member belt 201 in that order along the rotation direction of the photosensitive member belt 201, indicated by arrow A. A high voltage of approximately −4 kV to −5 kV is applied to the charger 205 by a power supply unit (not shown in the figure) to charge a portion, facing the charger 205, of the photosensitive member belt 201 with a uniform charging potential.

The LSU 206 sequentially subjects an image signal for each color from a grayscale converting unit (not shown in the figure) to optical intensity modulation or pulse width modulation using a laser-driving circuit (not shown in the figure). An exposure beam 214 is obtained by driving a semiconductor laser (not shown in the figure) with the modulated signal. The photosensitive member belt 201 is scanned with the exposure beam 214 to sequentially form an electrostatic latent image corresponding to the image signal for each color on the photosensitive member belt 201. A seam sensor 215 detects the seam of the photosensitive member belt 201 formed in a loop. When the seam sensor 215 detects the seam of the photosensitive member belt 201, a timing controller 216 controls the light-emission timing of the LSU 206 so that light avoids the seam of the photosensitive member belt 201 and so that the angular displacements for forming electrostatic latent images for the respective colors are the same.

Each of the developers 207 to 210 stores toner for the corresponding development color. The developers 207 to 210 come into contact with the photosensitive member belt 201 selectively according to the electrostatic latent image, corresponding to the image signal for each color, on the photosensitive member belt 201 and develop electrostatic latent images on the photosensitive member belt 201 with toner to produce the image for each color, thus forming a full-color image as a four-color overlaid image.

The intermediate transfer unit 211 includes a drum-shaped intermediate transfer body (transfer drum) 217 manufactured by winding a belt-shaped sheet made of, for example, conductive resin around an element tube made of metal such as aluminum and an intermediate-transfer-body cleaning unit 218 manufactured by forming, for example, rubber into a blade shape. While a four-color overlaid image is being formed on the intermediate transfer body 217, the intermediate-transfer-body cleaning unit 218 is out of contact with the intermediate transfer body 217. The intermediate-transfer-body cleaning unit 218 comes into contact with the intermediate transfer body 217 only when cleaning the intermediate transfer body 217 to remove from the intermediate transfer body 217 the remaining toner that has not been transferred onto a recording sheet 219 serving as a recording medium. Recording sheets are sent to a transfer-sheet conveying path 222 one at a time from a recording sheet cassette 220 by means of a sheet-feed roller 221.

A transfer unit 223 serving as a transferring unit transfers a full-color image on the intermediate transfer body 217 onto the recording sheet 219. The transfer unit 223 includes a transfer belt 224 manufactured by forming, for example, conductive rubber into a belt shape, a transfer device 225 that applies to the intermediate transfer body 217 a transfer bias for transferring the full-color image on the intermediate transfer body 217 onto the recording sheet 219, and a separator 226 that applies a bias to the intermediate transfer body 217 to prevent the recording sheet 219 from being electrostatically attracted onto the intermediate transfer body 217 after the full-color image has been transferred onto the recording sheet 219.

A fixing unit 227 includes a heat roller 228 having a heat source therein and a pressing roller 229. The fixing unit 227 fixes the transferred full-color image to the recording sheet 219 by applying pressure and heat to the recording sheet 219 while the heat roller 228 and the pressing roller 229 are rotating with the recording sheet being clamped therebetween, thus completing the full-color image.

Color copying with the structure described above is performed as follows. The following description assumes that the development of electrostatic latent images proceeds in the order of black, cyan, magenta, and yellow.

The photosensitive member belt 201 and the intermediate transfer body 217 are driven in the directions indicated by arrows A and B, respectively, by respective driving sources (not shown in the figure). In this state, a high voltage of approximately −4 kV to 5 kV is first applied to the charger 205 by the power supply unit (not shown in the figure) to allow the charger 205 to uniformly charge the surface of the photosensitive member belt 201 so that the surface carries a potential of approximately −700 V. Then, a certain period of time after the seam sensor 215 detects the seam of the photosensitive member belt 201 to allow light to avoid the seam of the photosensitive member belt 201, the photosensitive member belt 201 is irradiated with the exposure beam 214, in the form of a laser beam, corresponding to an image signal for black from the LSU 206. As a result, the portion irradiated with the exposure beam 214 on the photosensitive member belt 201 is discharged to form an electrostatic latent image.

On the other hand, the black developer 207 is brought into contact with the photosensitive member belt 201 with a predetermined timing. Because the black toner in the black developer 207 is negatively precharged, the black toner adheres only to the portion of the photosensitive member belt 201 that is discharged due to irradiation of the exposure beam 214 (electrostatic latent image portion); in short, development based on a so-called negative-positive process is carried out. The black toner image formed on the surface of the photosensitive member belt 201 by the black developer 207 is transferred onto the intermediate transfer body 217. Remaining toner that has not been transferred onto the intermediate transfer body 217 from the photosensitive member belt 201 is removed by the photosensitive-member cleaning unit 212, and furthermore, the charge on the photosensitive member belt 201 is removed by the discharger 213.

Next, the charger 205 uniformly charges the surface of the photosensitive member belt 201 so that the surface carries a potential of approximately −700 V. Then, a certain period of time after the seam sensor 215 detects the seam of the photosensitive member belt 201 to allow light to avoid the seam of the photosensitive member belt 201, the photosensitive member belt 201 is irradiated with the exposure beam 214, in the form of a laser beam, corresponding to an image signal for cyan from the LSU 206. As a result, the portion irradiated with the exposure beam 214 on the photosensitive member belt 201 is discharged to form an electrostatic latent image.

On the other hand, the cyan developer 208 is brought into contact with the photosensitive member belt 201 with a predetermined timing. Because the cyan toner in the cyan developer 208 is negatively precharged, the cyan toner adheres only to the portion of the photosensitive member belt 201 that is discharged due to irradiation of the exposure beam 214 (electrostatic latent image portion); in short, development based on a so-called negative-positive process is carried out. The cyan toner image formed on the surface of the photosensitive member belt 201 by the cyan developer 208 is transferred onto the intermediate transfer body 217 such that it overlays the black toner image. Remaining toner that has not been transferred onto the intermediate transfer body 217 from the photosensitive member belt 201 is removed by the photosensitive-member cleaning unit 212, and furthermore, the charge on the photosensitive member belt 201 is removed by the discharger 213.

Next, the charger 205 uniformly charges the surface of the photosensitive member belt 201 so that the surface carries a potential of approximately −700 V. Then, a certain period of time after the seam sensor 215 detects the seam of the photosensitive member belt 201 to allow light to avoid the seam of the photosensitive member belt 201, the photosensitive member belt 201 is irradiated with the exposure beam 214, in the form of a laser beam, corresponding to an image signal for magenta from the LSU 206. As a result, the portion irradiated with the exposure beam 214 on the photosensitive member belt 201 is discharged to form an electrostatic latent image.

On the other hand, the magenta developer 209 is brought into contact with the photosensitive member belt 201 with a predetermined timing. Because the magenta toner in the magenta developer 209 is negatively precharged, the magenta toner adheres only to the portion of the photosensitive member belt 201 that is discharged due to irradiation of the exposure beam 214 (electrostatic latent image portion); in short, development based on a so-called negative-positive process is carried out. The magenta toner image formed on the surface of the photosensitive member belt 201 by the magenta developer 209 is transferred onto the intermediate transfer body 217 such that it overlays the black toner image and the cyan toner image. Remaining toner that has not been transferred onto the intermediate transfer body 217 from the photosensitive member belt 201 is removed by the photosensitive-member cleaning unit 212, and furthermore, the charge on the photosensitive member belt 201 is removed by the discharger 213.

Furthermore, the charger 205 uniformly charges the surface of the photosensitive member belt 201 so that the surface carries a potential of approximately −700 V. Then, a certain period of time after the seam sensor 215 detects the seam of the photosensitive member belt 201 to allow light to avoid the seam of the photosensitive member belt 201, the photosensitive member belt 201 is irradiated with the exposure beam 214, in the form of a laser beam, corresponding to an image signal for yellow from the LSU 206. As a result, the portion irradiated with the exposure beam 214 on the photosensitive member belt 201 is discharged to form an electrostatic latent image.

On the other hand, the yellow developer 210 is brought into contact with the photosensitive member belt 201 with a predetermined timing. Because the yellow toner in the yellow developer 210 is negatively precharged, the yellow toner adheres only to the portion of the photosensitive member belt 201 that is discharged due to irradiation of the exposure beam 214 (electrostatic latent image portion); in short, development based on a so-called negative-positive process is carried out. The yellow toner image formed on the surface of the photosensitive member belt 201 by the yellow developer 210 is transferred onto the intermediate transfer body 217 such that it overlays the black toner image, the cyan toner image, and the magenta image to form a full-color image on the intermediate transfer body 217. Remaining toner that has not been transferred onto the intermediate transfer body 217 from the photosensitive member belt 201 is removed by the photosensitive-member cleaning unit 212, and furthermore, the charge on the photosensitive member belt 201 is removed by the discharger 213.

When the transfer unit 223, which has been out of contact with the intermediate transfer body 217, comes into contact with the intermediate transfer body 217 and a high voltage of approximately +1 kV is applied to the transfer device 225 by the power supply unit (not shown in the figure), the full-color image formed on the intermediate transfer body 217 is subjected to secondary transfer, by the transfer device 225, onto the recording sheet 219 conveyed from the recording sheet cassette 220 along the transfer-sheet conveying path 222.

Furthermore, a voltage is applied to the separator 226 by the power supply unit to exert an electrostatic force that attracts the recording sheet 219, thereby causing the recording sheet 219 to be peeled off the intermediate transfer body 217. Subsequently, the recording sheet 219 is sent to the fixing unit 227, where the full-color image is fixed by the clamping pressure of the heat roller 228 and the pressing roller 229, as well as the heat of the heat roller 228, and is then ejected to a sheet output tray 231 by a sheet-ejecting roller 230.

Furthermore, remaining toner on the intermediate transfer body 217, which has not been transferred onto the recording sheet 219 by the transfer unit 223, is removed by the intermediate-transfer-body cleaning unit 218. The intermediate-transfer-body cleaning unit 218 remains in angular displacement so as to be kept out of contact with the intermediate transfer body 217 until a full-color image is produced. In other words, after a full-color image has been transferred onto the recording sheet 219, the intermediate-transfer-body cleaning unit 218 comes into contact with the intermediate transfer body 217 to remove remaining toner from the intermediate transfer body 217. Full-color image formation for one sheet is completed through a series of operations as described above.

In the color copier according to the fourth embodiment, until the image for the final color is transferred onto the intermediate transfer body 217, the intermediate-transfer-body cleaning unit 218 serving as a moving member is kept out of contact with the surface of the intermediate transfer body 217 so that the image transferred onto the intermediate transfer body is not distorted. The intermediate-transfer-body cleaning unit 218 is brought into contact with the surface of the intermediate transfer body 217 before the front end of the surface of the intermediate transfer body bearing the full-color image that has been subjected to secondary transfer reaches the cleaning position. When the intermediate-transfer-body cleaning unit 218 is moved, image transfer is in progress at the primary transfer portion, which is the portion facing the photosensitive member belt 201 and the intermediate transfer body 217. Therefore, the movement of the intermediate-transfer-body cleaning unit 218 produces fluctuations in the driving load of the intermediate transfer body 217, which causes speed fluctuations of the intermediate transfer body 217, resulting in image distortion at the primary transfer portion. Degradation in image quality occurs in this manner.

To overcome this problem, according to the fourth embodiment, movement of the intermediate-transfer-body cleaning unit 218 is controlled in the same manner as with the movement control of the secondary transfer roller 10 according to the first and second embodiments. By doing so, because fluctuations in the driving load of the intermediate transfer body 217 resulting from the movement of the intermediate-transfer-body cleaning unit 218 can be reduced, degradation in image quality caused by speed fluctuations of the intermediate transfer body 217 can be suppressed.

Furthermore, if movement control alone of the intermediate-transfer-body cleaning unit 218 cannot sufficiently suppress degradation in image quality, drive control of the intermediate transfer body 217 may further be performed so as to suppress speed fluctuations of the intermediate transfer body resulting from the movement of the intermediate-transfer-body cleaning unit 218 by the use of the target moving distance of the intermediate-transfer-body cleaning unit 218, as described in the second embodiment.

In the color copier according to the fourth embodiment, because the developers 207 to 210 for their respective colors are moved towards or away from the surface of the photosensitive member belt 201, the movement of the developers 207 to 210 for their respective colors produces fluctuations in the driving load of the photosensitive member belt 201. When the developers 207 to 210 for their respective colors are moved, an electrostatic latent image is being written onto the photosensitive member belt 201 and image transfer is in progress at the primary transfer portion, which is the portion facing the photosensitive member belt 201 and the intermediate transfer body 217. As a result, fluctuations in the driving load of the photosensitive member belt 201 resulting from the movement of the developers 207 to 210 for their respective colors produce speed fluctuations of the photosensitive member belt 201, which leads to image disturbance at the position where an electrostatic latent image is written or at the primary transfer portion. Consequently, degradation in image quality occurs.

To suppress such degradation in image quality, movement of the developers 207 to 210 for their respective colors may be controlled in the same manner as with the movement control of the secondary transfer roller 10 according to the first and second embodiments. By doing so, because fluctuations in the driving load of the photosensitive member belt 201 resulting from the movement of the developers 207 to 210 for their respective colors can be reduced, degradation in image quality caused by speed fluctuations of the photosensitive member belt 201 can be suppressed.

Furthermore, if movement control alone of the developers 207 to 210 for their respective colors cannot sufficiently suppress degradation in image quality, drive control of the photosensitive member belt 201 may further be performed so as to suppress speed fluctuations of the photosensitive member belt 201 resulting from the movement of the developers 207 to 210 for their respective colors by the use of the target moving distance of the developers 207 to 210 for their respective colors, as described in the second embodiment.

The image forming apparatus according to the first to fourth embodiments includes, as image carriers, the intermediate transfer belts 6 and 124, the intermediate transfer body 217, and the photosensitive member belt 201. The image forming apparatus according to the first to fourth embodiments further includes the DC motor 46, serving as an image-carrier driving unit, that moves the image carriers; the image forming unit that produces an image on the image carriers; the secondary transfer roller 10, the cleaning device 127, the intermediate-transfer-body cleaning unit 218, and the developers 207 to 210 for their respective colors, serving as moving members, that are in contact with the image carriers and move towards or away from the image carriers; and the motor 26, serving as a moving-member driving unit, that moves the moving members towards or away from the image carriers. The image forming apparatus according to the first to fourth embodiment forms an image on a recording medium by eventually transferring the image produced on the image carriers onto the recording medium.

According to the first embodiment, the secondary-transfer position detector 15 serving as a detecting unit and the control system, such as the microcomputer 21 serving as a movement control unit, are provided. The secondary-transfer position detector 15 detects the position of the secondary transfer roller 10, serving as a moving member, at each predetermined sampling point in time while the secondary transfer roller 10 is moving. The control system applies feedback control to the motor 26 such that the detection result of the secondary-transfer position detector 15 follows the target value corresponding to each predetermined sampling point in time when the secondary transfer roller 10 moves while the image forming unit is forming an image on the intermediate transfer belt 6 serving as an image carrier. As a result, fluctuations in the driving load of the intermediate transfer belt 6 resulting from the movement of the secondary transfer roller 10 can be suppressed by setting target values appropriately. Therefore, fluctuations in the driving load of the intermediate transfer belt 6 occurring when the secondary transfer roller 10 is moved can be reduced, compared with the conventional technology where the movement of the secondary transfer roller 10 is not subjected to feedback control.

In particular, according to the first to fourth embodiments, the target value at each sampling time is obtained by substituting the sampling time into Equation (5) or (6) that represents, in the form of a polynomial of time, an acceleration pattern giving the minimum square integral of the time derivative of acceleration in the moving direction of the moving member. Therefore, a change in acceleration when the moving member is to move can be minimized, and furthermore, fluctuations in the driving load of the image carrier can be effectively suppressed.

In addition to the first embodiment, because the second embodiment provides the control system, such as the microcomputer 41 serving as a speed-control unit, that applies feedforward control to the motor for the image carrier based on a motor fluctuation current of the image carrier corresponding to the target value used by the motor 26 for the moving member, not only can fluctuations in the driving load of the image carrier resulting from the movement of the moving member be reduced, but also speed fluctuations of the image carrier due to fluctuations in the driving load that could not be eliminated can be suppressed. This makes it possible to more effectively suppress degradation in image quality.

Furthermore, according to the first and second embodiments, because the moving member is the secondary transfer roller 10 serving as a transfer member that clamps a recording medium between itself and the intermediate transfer belt 6 serving as an image carrier, degradation in image quality caused by fluctuations in the driving load of the intermediate transfer belt 6 occurring when a recording medium passes through the secondary transfer portion can also be suppressed.

In particular, according to the first and second embodiments, the feedback control described above is carried out when the secondary transfer roller 10 is moved to a setting position depending on the thickness of a recording medium conveyed between the intermediate transfer belt 6 and the secondary transfer roller 10. Therefore, degradation in image quality due to fluctuations in the driving load of the intermediate transfer belt 6 occurring when a recording medium passes through the secondary transfer portion can also be suppressed satisfactorily for recording media with a wide range of thicknesses.

According to the present invention, feedback control is applied to the movement of the moving member while the image forming unit is forming an image on the image carrier, thereby controlling the moving member so that it reaches a predetermined target position at each predetermined time while moving. Therefore, fluctuations in the driving load of the image carrier resulting from the movement of the moving member can be suppressed by setting appropriate target values that suppress fluctuations in the driving load of the image carrier when the moving member is to move. Consequently, fluctuations in the driving load of the image carrier occurring when the moving member is to move can be suppressed, compared with the conventional technology where the movement of the moving member is not subjected to feedback control.

In particular, if the driving unit of the image carrier is subjected to feedforward control by the use of a current of the driving unit of the image carrier corresponding to the target moving distance of the moving member, not only can fluctuations in the driving load of the image carrier due to vibration produced by the movement of the moving member be reduced, but also speed fluctuations of the image carrier due to fluctuations in a pressure resulting from the movement of the moving member can be controlled. Also, particularly if the distance between the intermediate transfer body serving as an image carrier and the transfer member (secondary transfer member) serving as a moving member is to be changed, it is possible to suppress speed fluctuations of the intermediate transfer body caused by vibration of the intermediate transfer body due to the shock produced when the movement of the secondary transfer member is started or stopped or caused by a change in pressure as a result of a change in the space between the intermediate transfer body and the secondary transfer member. This makes it possible to provide an image forming apparatus capable of forming images with less degradation in image quality.

As described above, according to one aspect of the present invention, fluctuations in the driving load of the intermediate transfer body resulting from the movement of the moving member can be suppressed. Therefore, image degradation can be suppressed more effectively with the present invention than with the conventional technology.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier on which an image is formed;

an image-carrier driving unit that drives the image carrier;

an image forming unit that forms the image on the image carrier;

a moving member that is movable towards and away from the image carrier via a swing fulcrum;

a moving-member driving unit that drives the moving member;

a detecting unit that detects a position of the moving member at predetermined sampling times while the moving member is moving; and a movement control unit that performs a feedback control on the moving-member driving unit such that a detection result of the detecting unit follows a target value corresponding to each of the predetermined sampling times when the moving member moves while the image forming unit is forming the image on the image carrier, wherein the target value is a value obtained by substituting the sampling times into an equation in the form of a polynomial of time, which represents an acceleration pattern giving a minimum square integral of a time derivative of an acceleration in a moving direction of the moving member.

2. The image forming apparatus according to claim 1, wherein the moving member is a transfer member that forms a transfer nip with the image carrier.

3. The image forming apparatus according to claim 2, wherein the movement control unit moves the transfer member to a position set according to a thickness of a recording medium that is conveyed into the transfer nip.

4. The image forming apparatus according to claim 1, wherein the image carrier is an intermediate transfer body, and the image forming unit forms the image on the intermediate transfer body.

5. The image forming apparatus according to claim 4, wherein the image forming apparatus includes a plurality of image carriers, and the plurality of image carriers includes photosensitive image carriers and the intermediate transfer body, and the image forming unit forms the image on the intermediate transfer body by superimposing images from the photosensitive carriers onto the intermediate transfer body.

6. The image forming apparatus according to claim 1, wherein a distance between the swing fulcrum and the detecting unit is larger than a distance between the swing fulcrum and the moving member.

7. An image forming apparatus comprising:

an image carrier on which an image is formed;

an image-carrier driving unit that drives the image carrier;

an image forming unit that forms the image on the image carrier;

a moving member that is movable towards and away from the image carrier via a swing fulcrum;

a moving-member driving unit that drives the moving member;

a detecting unit that detects a position of the moving member at predetermined sampling times while the moving member is moving;

a movement control unit that performs a feedback control on the moving-member driving unit such that a detection result of the detecting unit follows a target value corresponding to each of the predetermined sampling times when the moving member moves while the image forming unit is forming the image on the image carrier; and a speed-control unit that performs a feedforward control on the image-carrier driving unit based on the target value such that a speed fluctuation of the image carrier caused by a movement of the moving member is reduced.

8. The image forming apparatus according to claim 7, wherein a control amount for the feedforward control is a current for driving the image-carrier driving unit corresponding to a load fluctuation of the image carrier obtained based on the target value.

9. The image forming apparatus according to claim 7, wherein the moving member is a transfer member that forms a transfer nip with the image carrier.

10. The image forming apparatus according to claim 9, wherein the movement control unit moves the transfer member to a position set according to a thickness of a recording medium that is conveyed into the transfer nip.

11. The image forming apparatus according to claim 7, wherein the image carrier is an intermediate transfer body, and the image forming unit forms the image onto the intermediate transfer body.

12. The image forming apparatus according to claim 11, wherein the image forming apparatus includes a plurality of image carriers, and the plurality of image carriers includes photosensitive image carriers and the intermediate transfer body, and the image forming unit forms the image on the intermediate transfer body by superimposing images from the photosensitive carriers onto the intermediate transfer body.

13. The image forming apparatus according to claim 7, wherein a distance between the swing fulcrum and the detecting unit is larger than a distance between the swing fulcrum and the moving member.

* * * * *